US009406202B2

(12) United States Patent
Bansemer et al.

(10) Patent No.: US 9,406,202 B2
(45) Date of Patent: Aug. 2, 2016

(54) GAMING SYSTEM AND METHOD PROVIDING A CARD GAME WITH DECAY VALUE CARDS

(71) Applicant: IGT, Las Vegas, NV (US)

(72) Inventors: Mark W. Bansemer, Reno, NV (US); Christopher T. Brune, Carson City, NV (US); Bradford D. Brown, Sparks, NV (US); John E. Grime, Sparks, NV (US)

(73) Assignee: IGT, Las Vegas, NV (US)

( * ) Notice: Subject to any disclaimer, the term of this patent is extended or adjusted under 35 U.S.C. 154(b) by 270 days.

(21) Appl. No.: 14/161,249

(22) Filed: Jan. 22, 2014

(65) Prior Publication Data

US 2015/0206398 A1 Jul. 23, 2015

(51) Int. Cl.
*A63F 9/24* (2006.01)
*G07F 17/32* (2006.01)

(52) U.S. Cl.
CPC ..... *G07F 17/3293* (2013.01); *G07F 17/323* (2013.01); *G07F 17/3211* (2013.01); *G07F 17/3244* (2013.01)

(58) Field of Classification Search
CPC ..... G07F 17/3293; G07F 17/323; G07F 17/3244; G07F 17/3211
See application file for complete search history.

(56) References Cited

U.S. PATENT DOCUMENTS 5,100,137 A 3/1992 Fulton et al.
5,152,529 A 10/1992 Okada
5,167,413 A 12/1992 Fulton et al.
5,251,897 A 10/1993 Fulton et al.
5,322,295 A 6/1994 Cabot et al.
5,374,067 A 12/1994 Jones et al.
5,377,973 A 1/1995 Jones et al.
5,380,012 A 1/1995 Jones et al.
5,382,025 A 1/1995 Sklansky et al.
5,411,257 A 5/1995 Fulton et al.
5,431,408 A 7/1995 Adams et al.
5,437,451 A 8/1995 Fulton et al.
5,531,448 A 7/1996 Moody et al.
5,542,669 A 8/1996 Charron et al.
5,636,842 A 6/1997 Cabot et al.
5,732,950 A 3/1998 Moody et al.
5,755,621 A 5/1998 Marks et al.
5,803,809 A 9/1998 Yoseloff
5,820,460 A 10/1998 Fulton et al.
5,823,873 A 10/1998 Moody et al.

(Continued)

OTHER PUBLICATIONS

The Golden Touch Advertisement, Oct. 20, 2006.

*Primary Examiner* — Pierre E Elisca
*Assistant Examiner* — Carl V Larsen
(74) *Attorney, Agent, or Firm* — Neal, Gerber & Eisenberg LLP

(57) ABSTRACT

Various embodiments of the present disclosure are directed to a gaming system and method providing a card game with one or more decay value cards having a decay value. The decay value represents a quantity of plays of the card game that the decay value card will remain or be provided for a player. Various embodiments of the present disclosure provide a gaming session with one or more plays of a card game, wherein for a play of a card game, the gaming system: (1) designates one or more cards within a set of cards to be decay value cards; (2) determines a decay value for each decay value card; (3) determines whether to provide a decay value card during the play of the game; and (4) holds each decay value card having at least a minimum decay value for a subsequent play of the game.

30 Claims, 13 Drawing Sheets

(56) References Cited

U.S. PATENT DOCUMENTS 5,833,536 A 11/1998 Davids et al.
5,833,537 A 11/1998 Barrie
5,882,259 A 3/1999 Holmes et al.
5,911,418 A 6/1999 Adams et al.
5,954,335 A 9/1999 Moody et al.
5,957,774 A 9/1999 Holmes et al.
6,007,066 A 12/1999 Moody et al.
6,050,658 A 4/2000 O'Sullivan et al.
6,062,979 A 5/2000 Inoue
6,089,977 A 7/2000 Bennett
6,098,985 A 8/2000 Moody et al.
6,120,031 A 9/2000 Adams et al.
6,135,883 A 10/2000 Hachquet
6,176,781 B1 1/2001 Walker et al.
6,193,235 B1 2/2001 Vancura et al.
6,196,547 B1 3/2001 Pascal et al.
6,248,016 B1 6/2001 Walker et al.
6,251,013 B1 6/2001 Bennett
6,257,979 B1 7/2001 Walker et al.
6,270,412 B1 8/2001 Crawford et al.
6,311,976 B1 11/2001 Yoseloff et al.
6,311,978 B1 11/2001 Moody
6,322,078 B1 11/2001 Adams
6,332,839 B2 12/2001 Walker et al.
6,334,613 B1 1/2002 Yoseloff
6,375,570 B1 4/2002 Poole
6,406,023 B1 6/2002 Rowe
6,419,578 B1 7/2002 Moody et al.
6,422,940 B1 7/2002 Walker et al.
6,439,993 B1 8/2002 O'Halloran
6,443,452 B1 9/2002 Brune
6,464,581 B1 10/2002 Yoseloff et al.
6,474,645 B2 11/2002 Tarantino
6,494,454 B2 12/2002 Adams
6,517,074 B1 2/2003 Moody et al.
6,523,829 B1 2/2003 Walker et al.
6,533,658 B1 3/2003 Walker et al.
6,561,898 B2 5/2003 Moody
6,561,900 B1 5/2003 Baerlocher et al.
6,565,433 B1 5/2003 Baerlocher et al.
6,568,680 B1 5/2003 Moody et al.
6,569,014 B2 5/2003 Walker et al.
6,592,456 B2 7/2003 Walker et al.
6,602,137 B2 8/2003 Kaminkow et al.
6,604,740 B1 8/2003 Singer et al.
6,616,142 B2 9/2003 Adams
6,652,377 B1 11/2003 Moody
6,672,958 B2 * 1/2004 Bennett ..... G07F 17/3293 273/139
6,672,959 B2 1/2004 Moody et al.
6,726,427 B2 4/2004 Jarvis et al.
6,726,563 B1 4/2004 Baerlocher et al.
6,729,961 B1 5/2004 Millerschone
6,731,313 B1 5/2004 Kaminkow
6,776,416 B1 8/2004 Jackson
6,780,109 B2 8/2004 Kaminkow
6,786,818 B1 9/2004 Rothschild et al.
6,805,344 B2 10/2004 Abe et al.
6,805,349 B2 10/2004 Baerlocher et al.
6,851,349 B2 2/2005 Dohallow
6,866,583 B2 3/2005 Glavich et al.
6,905,406 B2 6/2005 Kaminkow et al.
6,905,408 B2 6/2005 Inoue
6,913,532 B2 7/2005 Baerlocher et al.
6,916,245 B1 7/2005 Vancura et al.
6,921,335 B2 7/2005 Rodgers et al.
6,935,950 B2 8/2005 Tarantino
6,955,356 B2 10/2005 Moody
6,955,600 B2 10/2005 Glavich et al.
6,964,418 B2 11/2005 Moody
6,969,316 B2 11/2005 Jarvis et al.
6,981,635 B1 1/2006 Hughs-Baird et al.
6,988,947 B2 1/2006 Baerlocher et al.
6,991,538 B2 1/2006 Cannon
6,994,624 B2 2/2006 Gold et al.
6,997,808 B2 2/2006 Rodgers et al.
7,014,559 B1 3/2006 Fong
7,048,275 B2 5/2006 Adams
7,056,207 B2 6/2006 Walker et al.
7,056,213 B2 6/2006 Ching et al.
7,059,965 B2 6/2006 Jackson
7,070,502 B1 7/2006 Bussick et al.
7,070,503 B2 7/2006 Rudolph
7,074,127 B2 7/2006 Cuddy et al.
7,090,580 B2 8/2006 Rodgers et al.
7,094,148 B2 8/2006 Baerlocher et al.
7,115,033 B1 10/2006 Timperley
7,137,628 B2 11/2006 Moody
7,137,888 B2 11/2006 Glavich et al.
7,156,397 B2 1/2007 Moody et al.
7,156,734 B1 1/2007 Walker et al.
7,169,042 B2 1/2007 Muir et al.
7,185,891 B2 3/2007 Jackson
7,192,345 B2 3/2007 Muir et al.
7,195,559 B2 3/2007 Gilmore et al.
7,201,655 B2 4/2007 Walker et al.
7,222,857 B2 5/2007 Moody
7,222,858 B2 5/2007 Moody
7,223,172 B2 5/2007 Baerlocher et al.
7,226,359 B2 6/2007 Bussick et al.
7,237,775 B2 7/2007 Thomas et al.
7,247,092 B2 7/2007 Jarvis et al.
7,252,591 B2 8/2007 Van Asdale
7,252,592 B2 8/2007 Rodgers et al.
7,258,611 B2 8/2007 Bigelow, Jr. et al.
7,297,057 B2 11/2007 Gerrard et al.
7,331,862 B2 2/2008 Rodgers et al.
7,331,866 B2 2/2008 Rodgers et al.
7,354,344 B2 4/2008 Paulsen et al.
7,371,168 B2 5/2008 Bilyeu et al.
7,371,170 B2 5/2008 Cregan et al.
7,387,568 B2 6/2008 Millerschone
7,390,258 B2 6/2008 Millerschone
7,393,276 B2 7/2008 Millerschone
7,396,279 B2 7/2008 Berman et al.
7,399,225 B2 7/2008 Kaminkow
7,402,103 B2 7/2008 Baerlocher
7,404,762 B2 7/2008 Moody
7,416,186 B2 8/2008 Walker et al.
7,419,162 B2 9/2008 Lancaster et al.
7,431,644 B2 10/2008 Moody
7,442,123 B2 10/2008 Brill et al.
7,467,542 B2 12/2008 Elrod
7,488,251 B2 2/2009 Kaminkow
7,513,826 B2 4/2009 Cuddy
7,524,243 B2 4/2009 Bansemer et al.
7,527,557 B2 5/2009 Jackson
7,553,231 B2 6/2009 Rodgers et al.
7,591,723 B2 9/2009 Cregan et al.
7,614,946 B2 11/2009 Nicely
7,641,197 B2 1/2010 Jackson
7,658,672 B1 2/2010 Wolf et al.
7,674,180 B2 3/2010 Graham et al.
7,699,696 B2 4/2010 Baerlocher et al.
7,748,714 B2 7/2010 Nicely et al.
7,749,059 B2 7/2010 Tarantino
7,749,061 B2 7/2010 Walker et al.
7,749,063 B2 7/2010 Belger et al.
7,771,274 B2 8/2010 Walker et al.
7,775,877 B2 8/2010 Baerlocher et al.
7,785,188 B2 8/2010 Cannon
7,785,196 B2 8/2010 Baerlocher et al.
7,789,751 B2 9/2010 Glavich et al.
7,789,755 B2 9/2010 Davis et al.
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,850,521 B2 12/2010 Rodgers et al.
7,857,693 B1 12/2010 Johnson et al.
7,857,695 B2 12/2010 Rodgers et al.
7,862,417 B2 1/2011 Nicely
7,862,430 B2 1/2011 Baerlocher et al.
7,867,073 B2 1/2011 Walker et al.

(56) References Cited

U.S. PATENT DOCUMENTS

| | | | |
|---|---|---|---|
| 7,892,081 | B2 | 2/2011 | Glavich et al. |
| 7,914,369 | B2 | 3/2011 | Walker et al. |
| 7,918,724 | B2 | 4/2011 | Walker et al. |
| 7,922,571 | B2 | 4/2011 | Walker et al. |
| 7,985,133 | B2 | 7/2011 | Baerlocher et al. |
| 7,993,191 | B2 | 8/2011 | Evans et al. |
| 7,993,199 | B2 | 8/2011 | Iddings et al. |
| 8,002,620 | B2 | 8/2011 | Nicely et al. |
| 8,002,625 | B2 | 8/2011 | Maya |
| 8,007,357 | B2 | 8/2011 | Cuddy et al. |
| 8,012,009 | B2 | 9/2011 | Iddings et al. |
| 8,021,226 | B2 | 9/2011 | Souza et al. |
| 8,043,155 | B2 | 10/2011 | Singer et al. |
| 8,062,119 | B2 | 11/2011 | Stern et al. |
| 8,083,578 | B2 | 12/2011 | Jackson |
| RE43,114 | E | 1/2012 | Walker et al. |
| 8,092,290 | B2 | 1/2012 | Darby |
| 8,092,291 | B2 | 1/2012 | Gerrard et al. |
| 8,092,302 | B2 | 1/2012 | Cuddy et al. |
| 8,100,748 | B2 | 1/2012 | Montross et al. |
| 8,105,151 | B2 | 1/2012 | Caputo et al. |
| 8,113,943 | B2 | 2/2012 | Cuddy |
| 8,118,662 | B2 | 2/2012 | Caputo et al. |
| 8,123,604 | B2 | 2/2012 | Lancaster et al. |
| 8,137,174 | B2 | 3/2012 | Nicely et al. |
| 8,137,179 | B2 | 3/2012 | Jensen et al. |
| 8,142,280 | B2 | 3/2012 | Walker et al. |
| 8,147,310 | B2 | 4/2012 | Jarvis et al. |
| 8,152,615 | B2 | 4/2012 | Lancaster et al. |
| 8,152,630 | B2 | 4/2012 | Cohen |
| 8,157,631 | B2 | 4/2012 | Lancaster et al. |
| 8,172,660 | B2 | 5/2012 | Lancaster et al. |
| 8,177,616 | B2 | 5/2012 | Nicely |
| 8,177,619 | B2 | 5/2012 | Jackson |
| 8,197,319 | B2 | 6/2012 | Nicely |
| 8,197,321 | B2 | 6/2012 | Wolf et al. |
| 8,206,212 | B2 | 6/2012 | Iddings et al. |
| 8,210,532 | B2 | 7/2012 | Evans et al. |
| 8,210,533 | B2 | 7/2012 | Evans et al. |
| 8,210,930 | B2 | 7/2012 | Graham et al. |
| 8,216,039 | B2 | 7/2012 | Nicely et al. |
| 8,216,062 | B2 | 7/2012 | Baerlocher et al. |
| 8,221,226 | B2 | 7/2012 | Baerlocher et al. |
| 8,226,469 | B2 | 7/2012 | Pawloski et al. |
| 8,231,454 | B2 | 7/2012 | Caputo |
| 8,235,780 | B2 | 8/2012 | Nicely |
| 8,235,781 | B2 | 8/2012 | Moody |
| 8,241,107 | B2 | 8/2012 | Moroney |
| 8,246,449 | B2 | 8/2012 | Baerlocher et al. |
| 8,251,798 | B2 | 8/2012 | Belger et al. |
| 8,262,448 | B2 | 9/2012 | Nicely et al. |
| 8,262,469 | B2 | 9/2012 | Iddings et al. |
| 8,277,307 | B2 | 10/2012 | Jensen et al. |
| 8,292,726 | B2 | 10/2012 | Souza et al. |
| RE43,822 | E | 11/2012 | Walker et al. |
| 8,328,614 | B2 | 12/2012 | Jones et al. |
| 8,328,623 | B2 | 12/2012 | Stern et al. |
| 8,328,629 | B2 | 12/2012 | Cohen et al. |
| 8,342,958 | B2 | 1/2013 | Cuddy et al. |
| 8,353,751 | B2 | 1/2013 | Bickley et al. |
| 8,366,532 | B1 | 2/2013 | Nicely |
| 8,376,836 | B2 | 2/2013 | Baerlocher et al. |
| 8,382,572 | B2 | 2/2013 | Hoffman et al. |
| 8,382,574 | B2 | 2/2013 | Marks et al. |
| 8,388,437 | B2 | 3/2013 | Nicely et al. |
| 8,393,958 | B2 | 3/2013 | Cohen |
| 8,398,472 | B2 | 3/2013 | Bansemer et al. |
| 8,398,473 | B2 | 3/2013 | Baerlocher et al. |
| 8,403,739 | B2 | 3/2013 | Jackson |
| 8,408,984 | B2 | 4/2013 | Walker et al. |
| 8,408,987 | B2 | 4/2013 | Kaminkow |
| 8,414,379 | B2 | 4/2013 | Nicely et al. |
| 8,419,518 | B2 | 4/2013 | Jarvis et al. |
| 8,419,524 | B2 | 4/2013 | Singer et al. |
| 8,425,303 | B2 | 4/2013 | Kennedy et al. |
| 8,434,764 | B2 | 5/2013 | Walker et al. |
| 8,444,465 | B2 | 5/2013 | Macaulay |
| 8,449,362 | B2 | 5/2013 | Jackson |
| 8,449,363 | B2 | 5/2013 | Baerlocher et al. |
| 8,449,364 | B2 | 5/2013 | Lancaster et al. |
| 8,449,378 | B2 | 5/2013 | Michaelson et al. |
| 8,475,253 | B1 | 7/2013 | Cole |
| 8,475,255 | B2 | 7/2013 | Wolf et al. |
| 8,485,880 | B2 | 7/2013 | Nicely |
| 8,491,381 | B2 | 7/2013 | Nicely et al. |
| 8,496,522 | B2 | 7/2013 | Caputo et al. |
| 8,500,542 | B2 | 8/2013 | Baerlocher et al. |
| 8,500,551 | B2 | 8/2013 | Baerlocher et al. |
| 8,506,388 | B2 | 8/2013 | Walker et al. |
| 8,517,818 | B2 | 8/2013 | Nicely et al. |
| 8,591,322 | B2 | 11/2013 | Cohen et al. |
| 2002/0056963 | A1 | 5/2002 | Adams |
| 2002/0145255 | A1* | 10/2002 | Rudolph ..... G07F 17/3293 273/292 |
| 2003/0203753 | A1 | 10/2003 | Muir et al. |
| 2004/0053676 | A1 | 3/2004 | Rodgers |
| 2004/0155407 | A1 | 8/2004 | Jackson |
| 2004/0157656 | A1 | 8/2004 | Jackson |
| 2004/0162133 | A1 | 8/2004 | Jackson |
| 2004/0166924 | A1 | 8/2004 | Jackson |
| 2004/0242320 | A1 | 12/2004 | Jackson |
| 2005/0035550 | A1 | 2/2005 | Jackson |
| 2005/0049031 | A1 | 3/2005 | Jackson |
| 2005/0051952 | A1 | 3/2005 | Jackson |
| 2005/0054436 | A1 | 3/2005 | Frizzell et al. |
| 2005/0087928 | A1 | 4/2005 | Jackson |
| 2005/0110215 | A1 | 5/2005 | Jackson |
| 2005/0148384 | A1 | 7/2005 | Marks et al. |
| 2005/0227754 | A1 | 10/2005 | Kaminkow et al. |
| 2005/0230917 | A1 | 10/2005 | Jackson |
| 2005/0255903 | A1 | 11/2005 | Jackson |
| 2006/0030387 | A1 | 2/2006 | Jackson |
| 2006/0030392 | A1 | 2/2006 | Rodgers et al. |
| 2006/0030395 | A1 | 2/2006 | Thomas |
| 2006/0063584 | A1 | 3/2006 | Brill et al. |
| 2006/0068875 | A1 | 3/2006 | Cregan et al. |
| 2006/0068884 | A1 | 3/2006 | Baerlocher et al. |
| 2006/0073876 | A1 | 4/2006 | Cuddy |
| 2006/0084492 | A1 | 4/2006 | Baerlocher et al. |
| 2006/0084494 | A1 | 4/2006 | Belger et al. |
| 2006/0089191 | A1 | 4/2006 | Singer et al. |
| 2006/0142077 | A1 | 6/2006 | Miles et al. |
| 2006/0154717 | A1 | 7/2006 | Jackson |
| 2006/0183532 | A1 | 8/2006 | Jackson |
| 2006/0205469 | A1 | 9/2006 | Schultz et al. |
| 2006/0267283 | A1 | 11/2006 | Jackson |
| 2006/0267284 | A1 | 11/2006 | Jackson |
| 2007/0021176 | A1 | 1/2007 | Jackson |
| 2007/0054721 | A1 | 3/2007 | Jackson |
| 2007/0060248 | A1 | 3/2007 | Rodgers et al. |
| 2007/0077976 | A1 | 4/2007 | Jackson |
| 2007/0228656 | A1 | 10/2007 | Jackson |
| 2007/0287532 | A1 | 12/2007 | Jackson |
| 2008/0076542 | A1 | 3/2008 | Iddings et al. |
| 2008/0079219 | A1 | 4/2008 | Jackson |
| 2008/0108409 | A1 | 5/2008 | Cole et al. |
| 2008/0108411 | A1 | 5/2008 | Jensen et al. |
| 2008/0111309 | A1 | 5/2008 | Nicely et al. |
| 2008/0113704 | A1 | 5/2008 | Jackson |
| 2008/0113735 | A1 | 5/2008 | Maya |
| 2008/0139267 | A1 | 6/2008 | Jackson |
| 2008/0161096 | A1 | 7/2008 | Jackson |
| 2008/0171585 | A1 | 7/2008 | Jackson |
| 2008/0171587 | A1 | 7/2008 | Jackson |
| 2008/0188278 | A1 | 8/2008 | Paulsen et al. |
| 2008/0254847 | A1 | 10/2008 | Millerschone |
| 2009/0111559 | A1 | 4/2009 | Souza et al. |
| 2010/0004051 | A1 | 1/2010 | Walker et al. |
| 2010/0022297 | A1 | 1/2010 | Saunders |
| 2010/0081497 | A1 | 4/2010 | Wolf et al. |
| 2010/0099480 | A1 | 4/2010 | Caputo |
| 2010/0113122 | A1 | 5/2010 | Walker et al. |
| 2010/0120484 | A1 | 5/2010 | Caputo et al. |
| 2010/0124968 | A1 | 5/2010 | Hoffman et al. |

(56) References Cited

U.S. PATENT DOCUMENTS

2010/0137056 A1 6/2010 Hoffman et al.
2010/0227661 A1 9/2010 Walker et al.
2011/0003627 A1 1/2011 Nicely et al.
2011/0014963 A1 1/2011 Walker et al.
2011/0095480 A1* 4/2011 Berman ..... G07F 17/32 273/292
2011/0111818 A1 5/2011 Baerlocher
2012/0115578 A1 5/2012 Caputo et al.
2012/0122534 A1 5/2012 Montross et al.
2012/0149451 A1 6/2012 Nicely et al.
2012/0214580 A1 8/2012 Hoffman et al.
2012/0270622 A1 10/2012 Pawloski et al.
2012/0270641 A1 10/2012 Baerlocher et al.
2012/0276971 A1 11/2012 Nicely et al.
2012/0282996 A1 11/2012 Nicely et al.
2012/0295683 A1 11/2012 Moody
2012/0322534 A1 12/2012 Belger et al.
2012/0329543 A1 12/2012 Nicely et al.
2013/0053125 A1 2/2013 Souza et al.
2013/0065669 A1 3/2013 Michaelson et al.
2013/0072282 A1* 3/2013 Nicely ..... G07F 17/3262 463/20
2013/0079110 A1 3/2013 Nicely et al.
2013/0079123 A1 3/2013 Nicely et al.
2013/0084961 A1 4/2013 Radisich et al.
2013/0084962 A1 4/2013 Radisich et al.
2013/0084994 A1 4/2013 Farrar
2013/0095911 A1 4/2013 Cohen et al.
2013/0095918 A1 4/2013 Cuddy et al.
2013/0116045 A1 5/2013 Baerlocher et al.
2013/0137504 A1 5/2013 Kaminkow et al.
2013/0150142 A1 6/2013 Caputo
2013/0150147 A1 6/2013 Marks et al.
2013/0150152 A1 6/2013 Cohen et al.
2013/0172064 A1 7/2013 Bansemer et al.
2013/0172065 A1 7/2013 Jackson
2013/0172067 A1 7/2013 Hoffman et al.
2013/0196748 A1 8/2013 Nicely et al.
2013/0203478 A1 8/2013 Kennedy et al.
2013/0217457 A1 8/2013 Jarvis et al.
2013/0225257 A1 8/2013 Singer et al.
2013/0231170 A1 9/2013 Macaulay
2013/0231176 A1 9/2013 Walker et al.
2014/0073387 A1* 3/2014 Haag ..... A63F 3/00157 463/13
2014/0206424 A1* 7/2014 Taylor ..... G07F 17/32 463/13

* cited by examiner

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

200

202

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

Select which cards to hold!

200

202

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

Congratulations! You win 400 credits!

| | | | |
|---|---|---|---|
| Royal Flush | 400 | 800 | 1200 |
| 4 Aces and Black Jack | 400 | 800 | 1200 |
| 4 2s, 3s, 4s, and Black Jack | 400 | 800 | 1200 |
| 4 of a Kind and Black Jack | 160 | 320 | 480 |
| 4 Aces or 4 Jacks | 160 | 320 | 480 |
| 4 2s, 3s, 4s | 80 | 160 | 240 |
| Straight Flush | 50 | 100 | 150 |
| 4 of a Kind | 25 | 50 | 75 |
| Full House | 9 | 18 | 27 |
| Flush | 7 | 14 | 21 |
| Straight | 4 | 8 | 12 |
| 3 of a Kind | 3 | 6 | 9 |
| Two Pair | 1 | 2 | 3 |
| Jacks or Better | 1 | 2 | 3 |

GAMING SYSTEM AND METHOD PROVIDING A CARD GAME WITH DECAY VALUE CARDS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player receives five cards dealt face up from a fifty-two card deck of playing cards. The player can discard none, one, a plurality, or all of the five cards. Each discarded card is replaced with another card from the deck. After the replacement (if any), the cards are evaluated for winning combinations. For a five card poker game, there are typically ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣ K♣ Q♣ J♣ 10♣ |
| 2 | Straight Flush | K♣ Q♣ J♣ 10♣ 9♣ |
| 3 | Four of a Kind | J♣ J♥ J♦ J♠ 3♣ |
| 4 | Full House | A♥ A♦ A♠ 6♦ 6♣ |
| 5 | Flush | A♣ J♣ 8♣ 6♣ 2♣ |
| 6 | Straight | 8♦ 7♠ 6♠ 5♠ 4♣ |
| 7 | Three of a Kind | Q♠ Q♥ Q♦ 6♦ 2♠ |
| 8 | Two Pair | 8♦ 8♥ 5♥ 5♣ 2♠ |
| 9 | One Pair | K♦ K♠ 8♣ 7♣ 2♥ |
| 10 | High Card | A♥ 10♣ 7♦ 5♠ 3♠ |

Within each category, hands are ranked according to the rank of individual cards, with an Ace being the highest card and a Two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of Straight Flush, Four of a Kind, or Flush. There are over a hundred equivalent hands for each Two Pair variation, and there are over 1,000 equivalent hands for each type of no-pair hand.

Numerous variations of poker exist, including Five Card Draw as mentioned above, Three Card Poker, Five Card Stud, Seven Card Stud, Hold 'Em (also called Texas Hold 'Em), Omaha (also called Omaha Hold 'Em), and Pai-Gow Poker. These games generally differ in the manner in which cards are dealt and in the manner and frequency in which bets are placed. Various criteria may also be used to determine the winning hand, including the highest ranking hand, the lowest ranking hand (Low-Ball), and where the highest ranking and lowest ranking hands each win half of the pot (High-Low).

In certain known multiplayer variations of poker, players play against each other rather than against a dealer or house. In certain of these variations, a round of play begins when each player has placed an initial bet, which is typically referred to as the ante, into the pot. The term pot typically refers to the total accumulation of antes and wagers made during a particular game. In other poker variations, such as Texas Hold 'Em (described in further detail below), only two players at a table make the initial bets, which are commonly referred to as the blinds.

The quantity of cards dealt depends on the particular variation of poker being played. For example, in Five Card Draw, each player is initially dealt five cards. In typical Three Card Poker games where the player plays against a dealer hand, the player is dealt a total of three cards and the dealer hand includes a total of three cards as well. In certain known Three Card Poker games, the initially dealt player hand and dealer hand are final and there is no option to replace or draw any new cards. In Texas Hold 'Em, Five Card Stud and Seven Card Stud, each player is initially dealt two cards. These cards are typically dealt face-down. However, depending on the game, some of the cards may be dealt face-up to the player. For example, in certain versions of Five Card Stud, each player is initially dealt one card face-up and one card face-down. In Texas Hold 'Em, each player is initially dealt two cards face-down, which are commonly referred to as the hole cards.

For certain poker variations in which additional cards are dealt or in which cards may be replaced, after the initial deal, a first round of wagering begins, in which the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by at least one remaining player such that each remaining player has wagered the same amount into the pot during the round.

Depending on the variation of poker being played, each game may have only an initial wager or several rounds of wagering, where each round of wagering is generally preceded by the dealing of one or more cards. A player wins a game of poker by being the last remaining player in the game after all other players have folded or by having the highest ranking hand when a showdown occurs. If two or more players remain alter the final round of wagering is complete, a showdown occurs. During the showdown, each remaining player's hand is displayed, the highest ranking hand is determined to be the winning hand, and the pot is provided to the player having the winning hand. If two or more players have identically ranked hands that are the highest ranking hands, the pot is split evenly among the tying players.

Of the poker variations mentioned above, Texas Hold 'Em is one of the more popular versions. Texas Hold 'Em is generally a multi-player card game played at a live card table or via a computer-based virtual card table. In one version of a live card table game of Texas Hold 'Em, only two players at a table make the initial bets, commonly referred to as the blinds. The blinds include a big blind and a small blind. The big blind is typically twice the value of the small blind. In a blind-based game such as Texas Hold 'Em, all players are initially eligible to receive a hand, even if they do not place the big blind or the small blind. After the players have anted (if an ante is required), each player eligible for play is dealt an initial set of cards. Each of the players must match the blinds, raise the blinds or fold. Texas Hold 'Em includes a designated quantity of community cards (usually five) that can be used by all of the players in combination with their hole cards. However, in certain variations, there may only be three community cards. In certain Texas Hold 'Em games, the community cards are dealt over the course of several wagering rounds. For example, the gaming device or dealer deals the flop (usually three cards), the turn (usually one card), and the river (usually one card). The winning hand is the resulting five card hand (of the combined seven cards) having the highest poker rank. This method of determining a winning five card hand is similar to determining a winning hand in Seven Card Stud. However, Seven Card Stud does not utilize community cards as in Texas Hold 'Em. In other variations of Texas Hold 'Em, where the quantity of community cards is only three, the flop is a single card rather than three cards.

There is a continuing need exists for new and exciting poker games to keep players engaged during game play, increase entertainment value, and provide additional excitement to players.

SUMMARY

Various embodiments of the present disclosure are directed to a gaming system and method providing a card game with one or more decay value cards, wherein each decay value card has a decay value. In various embodiments, each decay value card in the player's hand provides the player an advantage. The decay value of each decay value card represents a quantity of plays of the card game that the decay value card will remain or be provided for the player. More specifically, various embodiments of the present disclosure provide a gaming session with one or more plays of a card game. For one or more plays of a card game of the gaming session, the gaming system: (1) designates one or more cards within a set of cards to be decay value cards; (2) determines a decay value for each decay value card; (3) determines whether to provide any of the decay value cards to the player during the play of the card game; and (4) at the end of or after the play of the card game, holds each decay value card having at least a minimum decay value for a subsequent play of the card game, wherein the minimum decay value is a predefined value.

In one embodiment, the card game is a draw poker card game wherein the decay value cards function as wild cards. For each of a plurality of plays of the card game, the gaming system designates one or more of the cards within a first set of cards (such as a virtual deck of cards) as decay value cards. For each designated decay value card within the first set of cards, the gaming system also determines a decay value for that decay value card. For an initial hand of cards, the gaming system: (i) displays any cards from a previous play of the card game which are decay value cards with at least a minimum decay value; (ii) completes the initial hand of cards by randomly selecting cards from the first set of cards which may include one or more of the designated decay value cards of the first set of cards, wherein each decay value card has a decay value associated with the card (such as on the face of the card); (iii) displays the complete initial hand of cards face up; (iv) receives a selection of zero, one or a plurality of cards in the initial hand to hold and discards any unselected cards; (v) replaces each discarded card with a replacement card from the first set of cards for a final hand of cards; and (vi) displays the final hand of cards. The gaming system determines any awards associated with the final hand including evaluating any decay value card within the final hand as a wild card in this embodiment, and displays any awards associated with the final hand. In this embodiment, if the final hand includes any decay value cards, the gaming system: (i) reduces the decay value of each decay value card; and (ii) holds each decay value card having at least the minimum decay value for a subsequent play of the card game.

In one example of this embodiment, for each of a plurality of plays of a draw poker card game, the gaming system designates three decay value cards within a first set of cards which is a virtual deck of 52 cards. The gaming system in this example embodiment determines a decay value of five plays of the card game for each of the three decay value cards within the virtual deck of 52 cards. Each decay value card in this example embodiment functions as a wild card. For a first play of a card game, for an initial hand of cards, the gaming system: (i) displays zero cards from a previous play of the card game which are decay value cards with at least a minimum decay value; (ii) completes the initial hand of cards by randomly selecting five cards from the virtual deck of 52 cards; (iii) displays the complete initial hand of cards face up; (iv) receives a selection of zero, one or a plurality of cards in the initial hand to hold and discards any unselected cards; (v) replaces each discarded card with a replacement card from the virtual deck of cards for a final hand of cards; and (vi) displays the final hand of cards. In this example embodiment, if any decay value cards are selected from the virtual deck of 52 cards for the initial hand or as a replacement card, the gaming system displays the decay value of each decay value card on the face of the decay value card. In this example embodiment, the final hand for the first play of the card game includes one decay value card with a decay value of five plays of the card game. The gaming system determines any awards associated with the final hand of cards including evaluating the decay value card within the final hand as a wild card in this embodiment, and displays any awards associated with the final hand. In this example embodiment, the predefined minimum decay value is one. Since the final hand includes a decay value card, the gaming system: (i) reduces the decay value of the decay value card from five to four plays of the card game; and (ii) for a subsequent play of the card game, holds the decay value card because in this embodiment, it has at least the minimum decay value of one.

In this example embodiment, for the subsequent second play of the card game, the gaming system uses a new second virtual deck of 51 cards removing the decay value card held from the previous play of the card game. For an initial hand of cards, the gaming system: (i) displays the decay value card held from the previous play of the card game; (ii) completes the initial hand of cards by randomly selecting four cards from the new second virtual deck of 51 cards which includes the two remaining designated decay value cards with a decay value of five associated with each decay value card; (iii) displays the complete initial hand of cards face up; (iv) receives a selection of zero, one or a plurality of cards in the initial hand to hold and discards any unselected cards; (v) replaces each discarded card with a replacement card from the second new virtual deck of cards for a final hand of cards; and (vi) displays the final hand of cards. In this embodiment, the final hand of cards includes one decay value card from the previous or first play of the card game. The gaming system determines any awards associated with the final hand of cards including evaluating any decay value card within the final hand of this second play of the card game as a wild card in this embodiment, and displays any awards associated with the final hand of cards of this second play of the card game. Since the final hand of cards includes a decay value card from the previous play of the card game, the gaming system: (i) reduces the decay value of the decay value card from four to three plays of the card game; and (ii) for the subsequent or third play of the card game, holds the decay value card because in this embodiment, it has at least the minimum decay value of one.

It should be appreciated from the example embodiment described above, that the gaming system continues to hold each decay value card having at least a minimum decay value for a subsequent play of the card game for the number of plays of the card game as indicated by the decay value of the card. The minimum decay value for the example embodiment described above is predefined to be one. Thus, in this example embodiment, the gaming system continues to reduce the decay value of each decay value card at the end of the play of the card game and continues to hold each decay value card having a decay value of at least the minimum decay value of one for a subsequent play of the card game.

It should thus be appreciated that the present disclosure provides a new and exciting poker card game offering a plurality of cards, wherein one or more cards have a decay value. The present disclosure provides for players to have multiple decay value cards at the same time and provides for each decay value card to be employed for a different quantity of plays of the card game. Each decay value card provides the player an advantage such as by functioning as a wild card. Multiple decay value cards in one hand provide an automatic win. Thus, it should be appreciated that the present disclosure provides a card game that keeps the players engaged during card game play, provides an incentive for players to continue playing, and increases entertainment value.

Additional features and advantages are described herein, and will be apparent from, the following Detailed Description and the Figures.

DETAILED DESCRIPTION

Card Game with Decay Value Cards

Various embodiments of the present disclosure are directed to a gaming system and method providing a card game with one or more decay value cards and each decay value card having a decay value. While the card game of the present disclosure is employed as a base or primary card game in the embodiments described below, it should be appreciated that the card game may additionally or alternatively be employed as or in association with a bonus card game or a secondary card game. Moreover, while any credit balances, any wagers, and any awards are displayed as amounts of monetary currency, credits, or "chips" representing monetary currency or credits in the embodiments described below, one or more of such credit balances, such wagers, and such awards may be for non-monetary credits, promotional credits, player tracking points or credits, or chips representing any thereof.

It should be appreciated that in one embodiment, the decay value cards are funded by the main wager for the primary game. In other alternative embodiments, the decay value cards are funded, at least in part, via a side bet or side wager. In one such embodiment, a player must place or wager a side bet to be eligible to receive decay value cards. In one embodiment, the player must place the maximum bet and the side bet to be eligible to receive decay value cards in a play of a card game within a gaming session.

While the example card games are variations of draw poker games in certain of the example embodiments described below, it should be appreciated that the present disclosure contemplates employing any suitable type of card game instead of or in addition to draw poker card games.

Figure 1A:
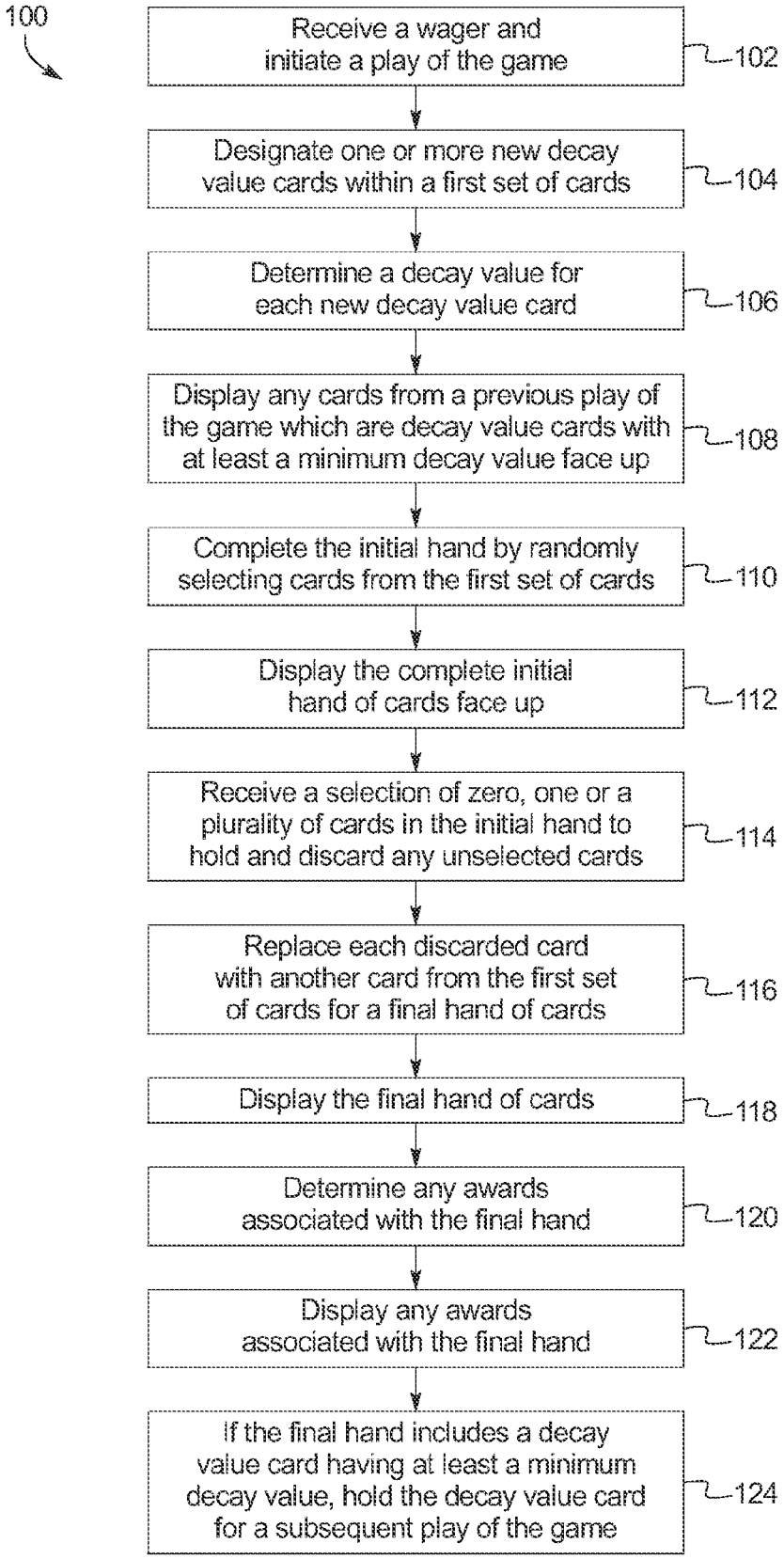
FIG. 1A is a flowchart illustrating a method of operating an example embodiment of the gaming system of the present disclosure configured to operate the card game with decay value cards.

Referring now to FIG. 1A, one embodiment of the process or method of operating a gaming system of the present disclosure is generally illustrated, and indicated by numeral 100. In various embodiments, method 100 is represented by a set of instructions stored in one or more memories and executed by one or more processors. Although method 100 is described with reference to the flowchart shown in FIG. 1A, it should be appreciated that many other processes of performing the acts associated with this illustrated method 100 may be employed. For example, the order of certain of the illustrated blocks and/or diamonds may be changed, certain of the illustrated blocks and/or diamonds may be optional, and/or certain of the illustrated blocks and/or diamonds may not be employed.

In this example embodiment, the method 100 includes receiving a wager from a player for a play of the draw poker card game within a gaming session as indicated by block 102. In this embodiment, after receiving the wager, the method 100 includes designating one or more cards within a first set of cards to be decay value cards, as indicated by block 104, and determining a decay value for each designated decay value card as indicated by block 106. The designation of decay value cards and determination of the decay value for each decay value card could be random or predetermined. For an initial hand of cards within a play of the card game, the method 100 includes: (i) displaying any cards from a previous play of the card game which are decay value cards with at least a minimum decay value, as indicated by block 108; (ii) completing the initial hand of cards by randomly selecting cards from the first set of cards (including one or more designated decay value cards), as indicated by block 110; (iii) displaying the complete initial hand of cards face up, as indicated by 112; (iv) receiving a selection of zero, one or a plurality of cards in the initial hand to discard, and discarding any selected cards, as indicated by block 114; (v) replacing each discarded card with a replacement card from the first set of cards for a final hand of cards, as indicated by block 116; and (vi) displaying the final hand of cards, as indicated by block 118. The method 100 includes determining any awards associated with the final hand, as indicated by block 120, and displaying any awards associated with the final hand as indicated by block 122.

It should be appreciated that in various alternative embodiments, the method 100 includes displaying any cards from a previous play of the card game which are decay value cards with at least a minimum decay value, as indicated by block 108, before designating one or more cards within a first set of cards to be decay value cards, as indicated by block 104.

If the final hand of cards for a play of the card game includes any decay value card, the gaming system determines whether the decay value for each decay value card within the final hand is at least the minimum decay value. As shown by block 124, for each decay value card having at least the minimum decay value, the method 100 includes holding each decay value card for a subsequent play of the card game.

In certain alternative embodiments, the gaming system reduces the decay value of each decay value card within the final hand at the end of the play of the card game. The gaming system then determines whether the remaining decay value of any of the decay value cards from the final hand is at least the minimum decay value. For each decay value card having at least the minimum decay value, the method includes holding each decay value card for a subsequent play of the card game.

Turning now to FIGS. 2A, 2B, 2C and 2D, which illustrate screen shots of an example embodiment of a first play of a card game of the gaming system of the present disclosure providing the card game with decay value cards from the perspective of a player in accordance with method 100 described above with respect to FIG. 1A. In this example embodiment, the gaming system display 200 displays meters which indicate the player's balance 220, the current bet 222, and the award for the current play of the card game 224.

In this example embodiment, for each of a plurality of plays of a draw poker card game, each decay value card functions as a wild card and the decay value represents the quantity of plays of the card game that the decay value card will be employed. The wager for this example embodiment is 5 credits. Upon receiving a wager, the gaming system of this embodiment, designates one or more decay value cards within the first set of cards. In this embodiment, the first set of cards is a first virtual deck of 52 cards. The gaming system determines a decay value for each decay value card within the first virtual deck of cards. In this example embodiment, the gaming system designates four cards: 2♥, 2♣, 2♦, and 2♠, within the first virtual deck of cards to be decay value cards and the gaming system determines the decay value of each of the four decay value card to be five plays of the card game. It should be appreciated that each of the four decay value cards could have the same decay value or could have different decay values.

Figure 2A:
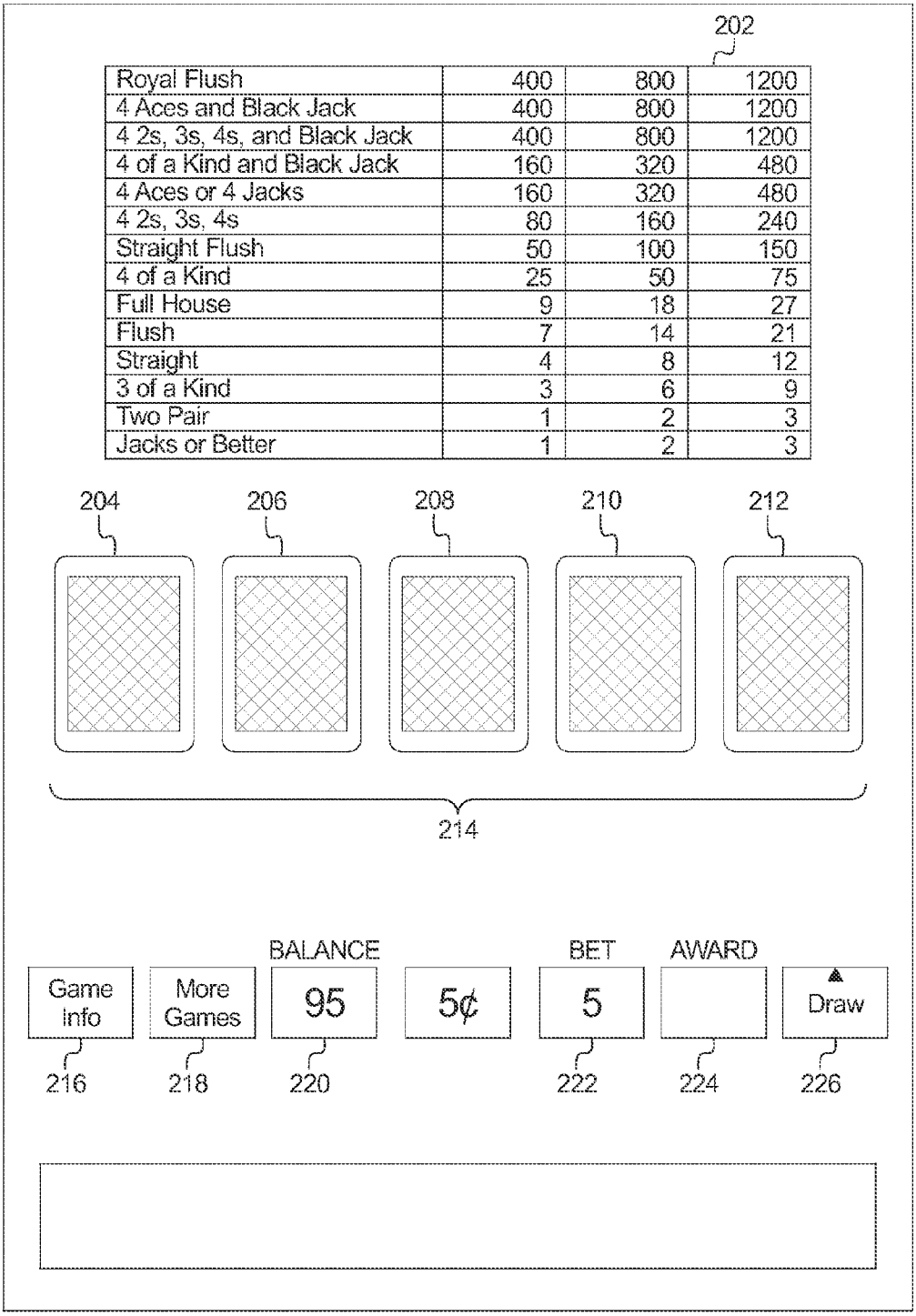
FIGS. 2A, 2B, 2C, and 2D illustrate screen shots of an example embodiment of a first play of a card game for the gaming system of the present disclosure providing plays of the card game with decay value cards according to the method of FIG. 1A.

Turning to FIG. 2A, for an initial hand of cards 214 for the play of the card game, the gaming system first displays any cards from a previous play of the card game which are decay value cards with at least a minimum decay value. In this example embodiment, the gaming system displays zero decay value cards from a previous play of the card game, as indicated by card positions 204, 206, 208, 210, and 212, because this is the first play of the card game.

Figure 2B:
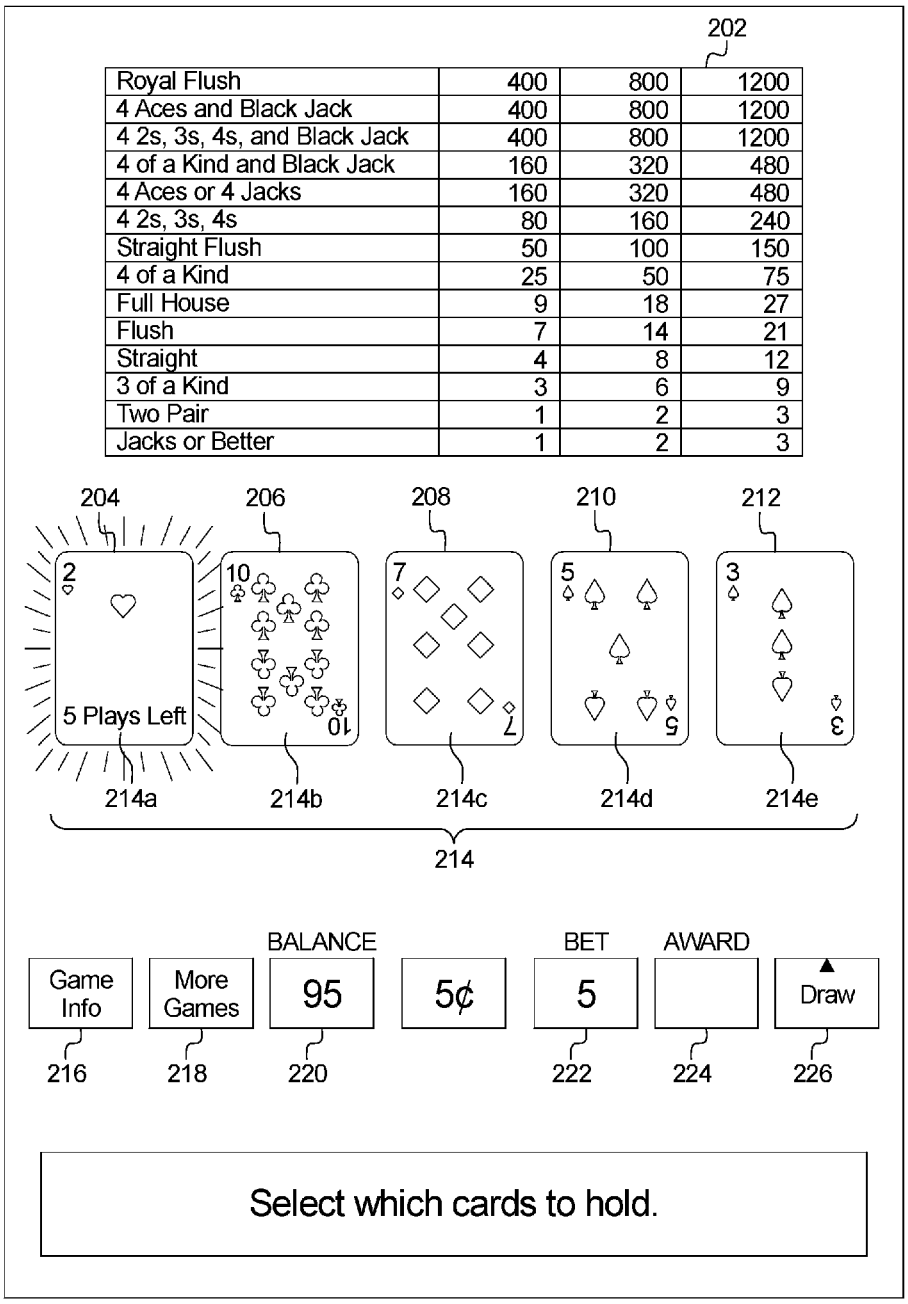

Turning to FIG. 2B, the gaming system completes the initial hand of cards 214 by randomly selecting five cards: 2♥, 10♣, 7♦, 5♠, and 3♠ as indicated by 214*a*, 214*b*, 214*c*, 214*d*, and 214*e* from the first virtual deck of cards and displays the complete initial hand face up as shown in card positions 204, 206, 208, 210 and 212. The 2♥, as indicated by 214*a* is a decay value card having a decay value of five plays of the card game as indicated at the bottom of position 204. The gaming system enables the player to select which cards from the initial hand 214 to hold. In this example embodiment, the gaming system receives a selection to hold one card, the 2♥, as indicated by 214*a*. The gaming system discards the remaining cards.

Figure 2C:
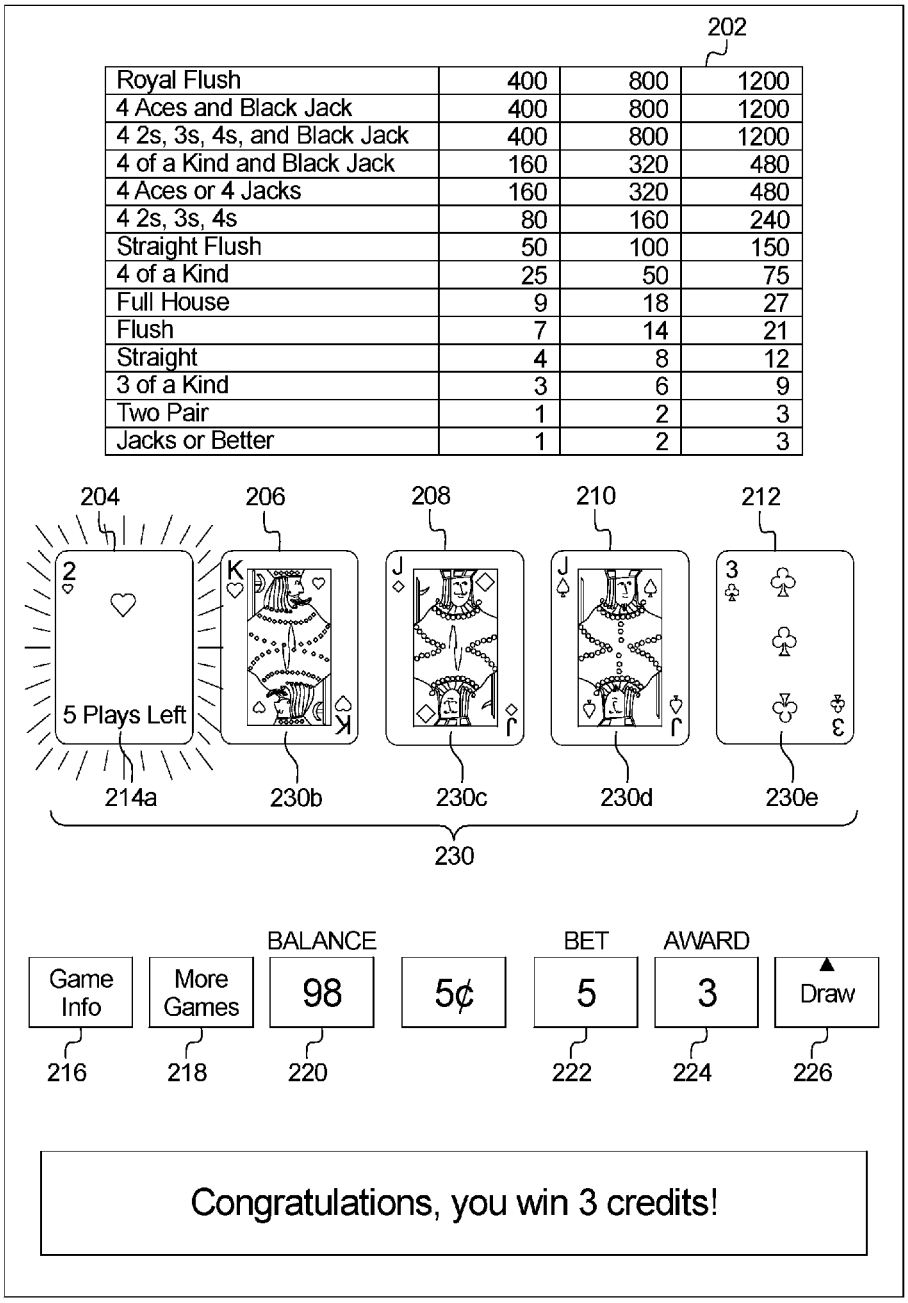

Turning now to FIG. 2C, the gaming system replaces the four discarded cards with four replacement cards: K♥, J♦, J♠, and 3♣, as indicated by 230*b*, 230*c*, 230*d*, and 230*e* from the first virtual deck of cards for a final hand 230. The final hand 230 for this example embodiment includes of: 2♥, K♥, J♦, J♠, and 3♣ as indicated by 214*a*, 230*b*, 230*c*, 230*d*, and 230*e*. The gaming system displays the final hand 230 in positions 204, 206, 208, 210, and 212. The gaming system determines whether the final hand of cards includes any winning card combinations. In this embodiment, the decay value card functions as a wild card and thus is evaluated as a Jack. According to paytable 210, based on a 5 credit wager, the best winning card combination of the final hand is "3 of a Kind" for an award of 3 credits, and the gaming system displays the award for the final hand of this play of the card game in the meter as indicated by 220 and 224.

Figure 2D:
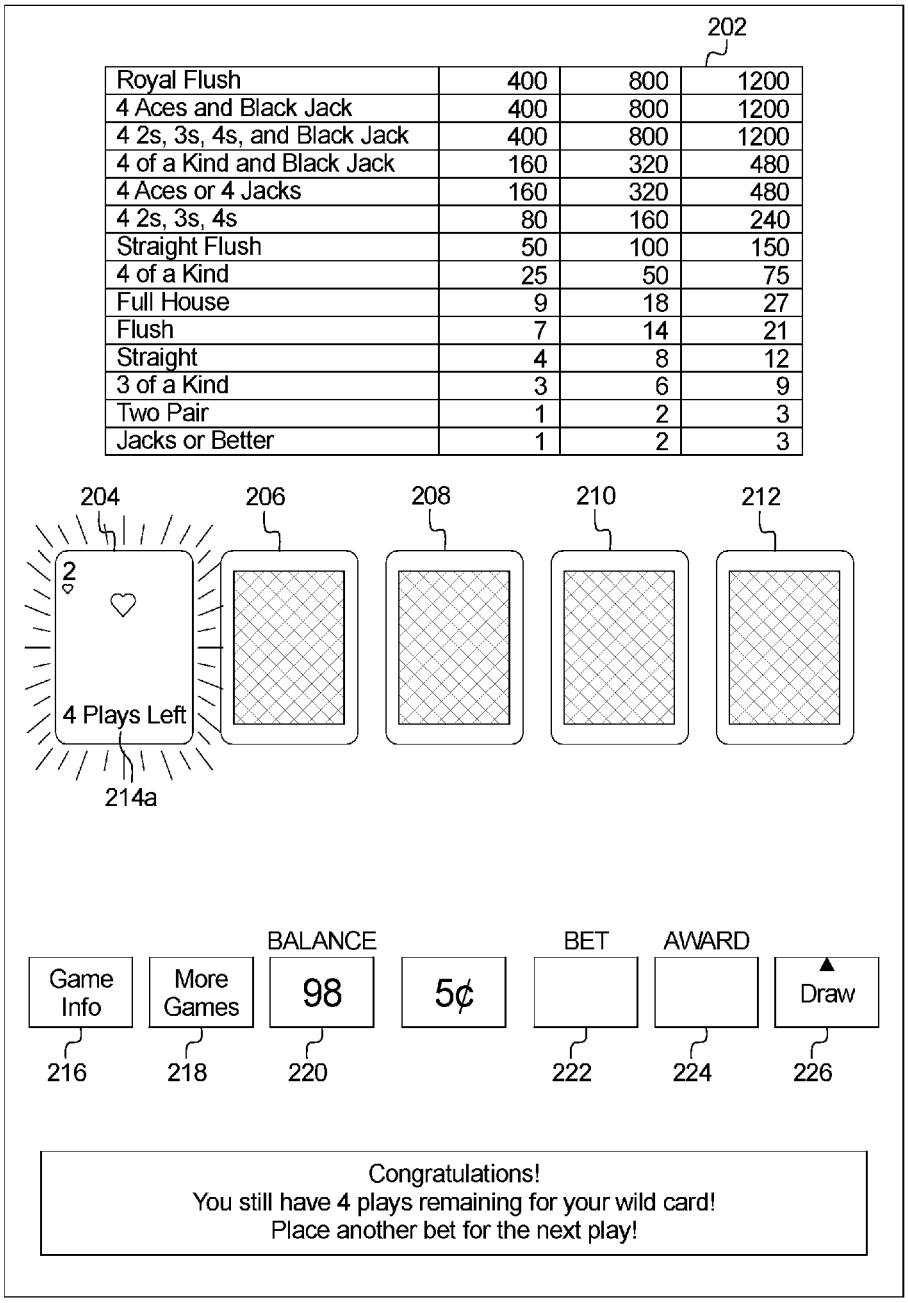

In this embodiment, the minimum decay value is one. Turning now to FIG. 2D, since the final hand includes the 2♥, which is a decay value card, the gaming system reduces the decay value of the 2♥, from five to four plays of the card game remaining. Since the decay value of four plays of the card game is greater than the minimum decay value of one, the gaming system holds the 2♥ for a subsequent play of the card game. That is, if the player places another wager for another play of the card game, the gaming system will carry the 2♥ as a wild card for the next play of the card game.

Turning now to FIGS. 3A, 3B, 3C and 3D, which illustrate screen shots of an example embodiment of a second play of the draw poker card game of the gaming system of the present disclosure in accordance with method 100 described above with respect to FIG. 1A. Using the example embodiment described above for FIGS. 2A, 2B, 2C, and 2D, in this example embodiment, the gaming system display 200 displays meters which indicate the player's balance 220, the current bet 222, and the award for the current play of the card game 224.

Figure 3A:
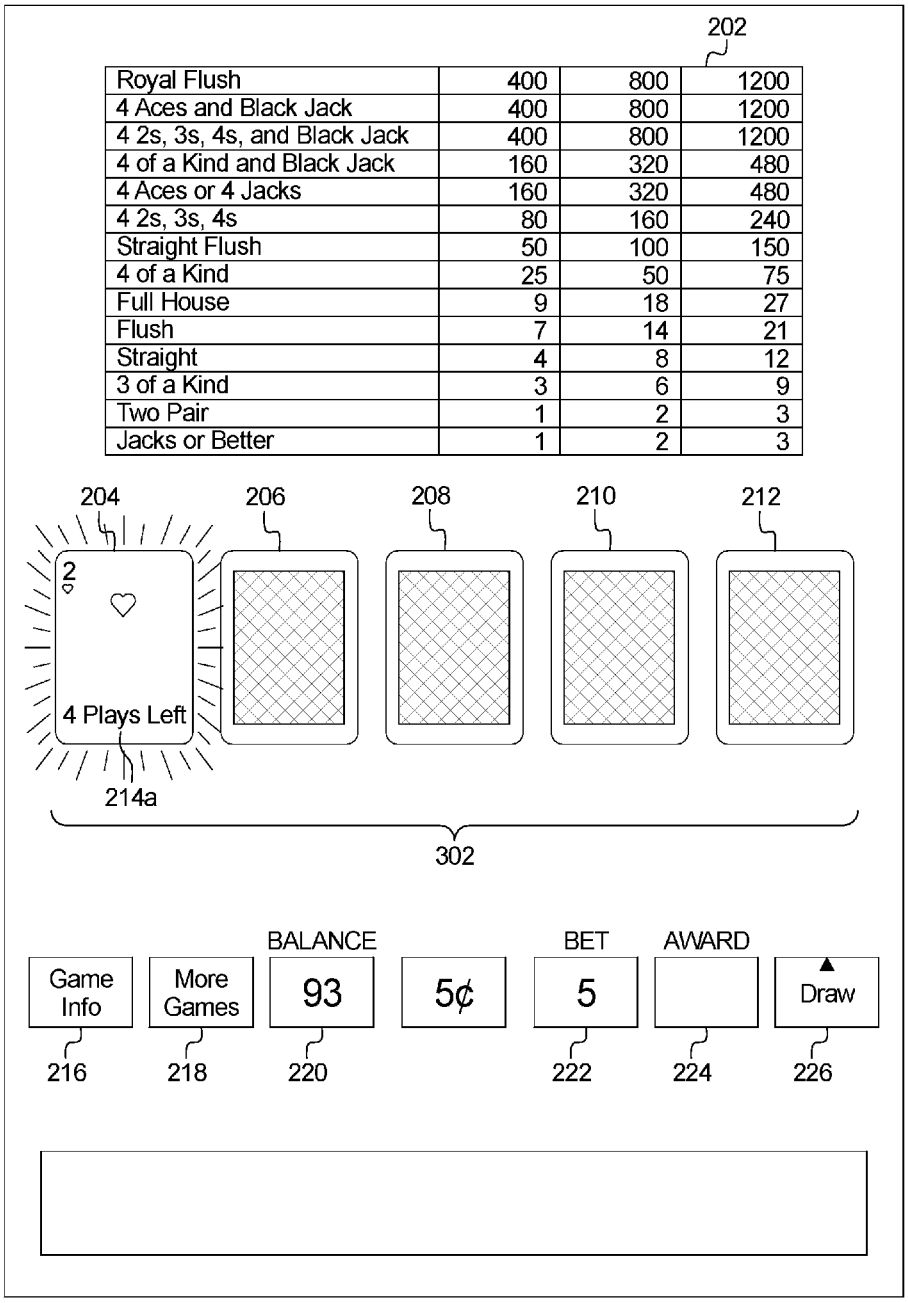
FIGS. 3A, 3B, 3C, and 3D illustrate screen shots of an example embodiment of a second play of a card game for the gaming system of the present disclosure providing plays of the card game with decay value cards according to the method of FIG. 1A.

Turning now to FIG. 3A, because the gaming system receives another wager, the gaming session continues with another play of the draw poker card game. In this embodiment, since the 2♥ is a decay value card held from the previous play of the card game, the gaming system removes the 2♥ from the virtual deck of cards and uses a second new virtual deck of 51 for the second play of the card game. In this embodiment, the designated decay value cards are 2♣, 2♦, and 2♠ within the second new virtual deck of cards and the 2♥, from the previous play of the card game. The decay value for the 2♣, 2♦, and 2♠, is five plays of the card game and the decay value for the 2♥, is four plays of the card game as determined in the previous play of the card game. As shown in FIG. 3A, for the initial hand 302 the gaming system displays the cards from the previous play of the card game which are decay value cards with at least a minimum decay value of one. In this example embodiment, the gaming system displays the 2♥ 214*a* with four plays of the card game remaining (including this second play of the card game) as indicated by position 204 in FIG. 3A.

Figure 3B:
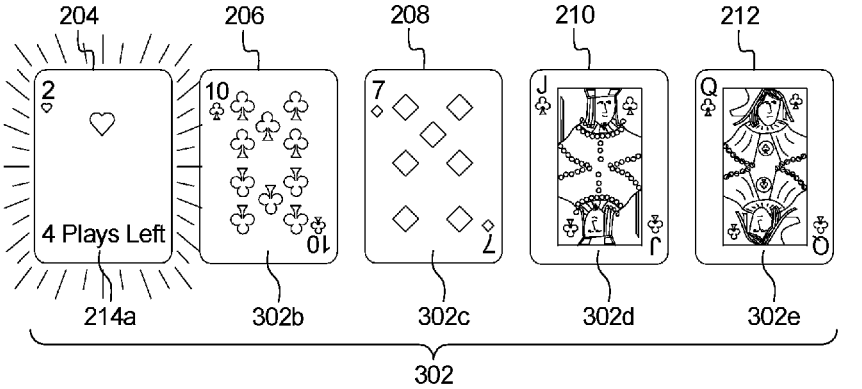
Figure 3B:
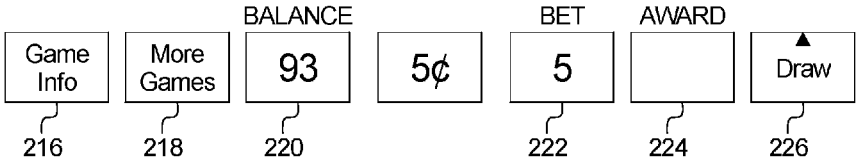

Turning now to FIG. 3B, the gaming system completes the initial hand of cards by randomly selecting four cards: 10♣, 7♦, J♣, and Q♣ as indicated by 302*b*, 302*c*, 302*d*, and 302*e* from the second new virtual deck of 51 cards and displays the complete initial hand 302 face up as shown by positions 204, 206, 208, 210, and 212. In this embodiment, the decay value card 214*a* from the previous play of the card game is in position 204. The gaming system enables the player to select which cards within the initial hand 302 to hold. In this example embodiment, the gaming system receives a selection of four cards to hold: 2♥, 10♣, J♣, and Q♣ as indicated by 214*a*, 302*b*, 302*d*, and 302*e*. The gaming system discards the remaining card.

Figure 3C:
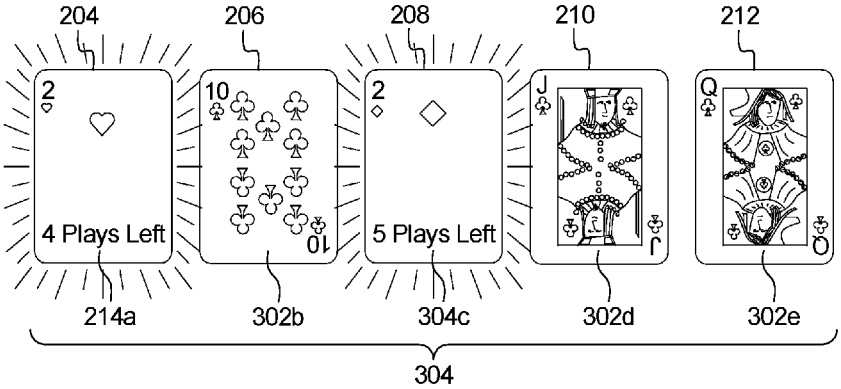
Figure 3C:
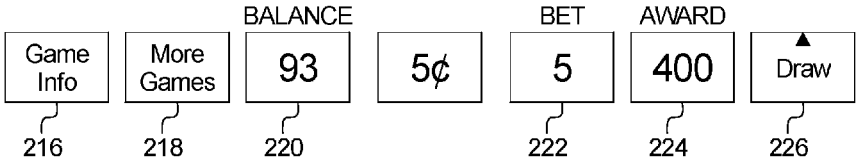

Turning now to FIG. 3C, the gaming system replaces the discarded card with a replacement card, the 2♦, as indicated by 304*c*, from the second new virtual deck of cards for a final hand 304. The gaming system displays the final hand 304 which includes of: 2♥, 10♣, 2♦, J♣, and Q♣ as indicated by 214*a*, 302*b*, 304*c*, 302*d*, and 302*e*. The 2♦, indicated as 304*c*, is a decay value card having a decay value of five plays of the card game as indicated at the bottom of position 208. The gaming system determines whether the final hand of cards includes any winning card combinations. In this embodiment, both decay value cards function as wild cards. Thus, for the greatest possible winning card combination, the two decay value cards in the final hand are evaluated as the A♣ and the K♣ for a winning card combination of a "Royal Flush" for an award of 400 credits. The gaming system displays the award for this play of the card game in the meter as indicated by 220 and 224.

Figure 3D:
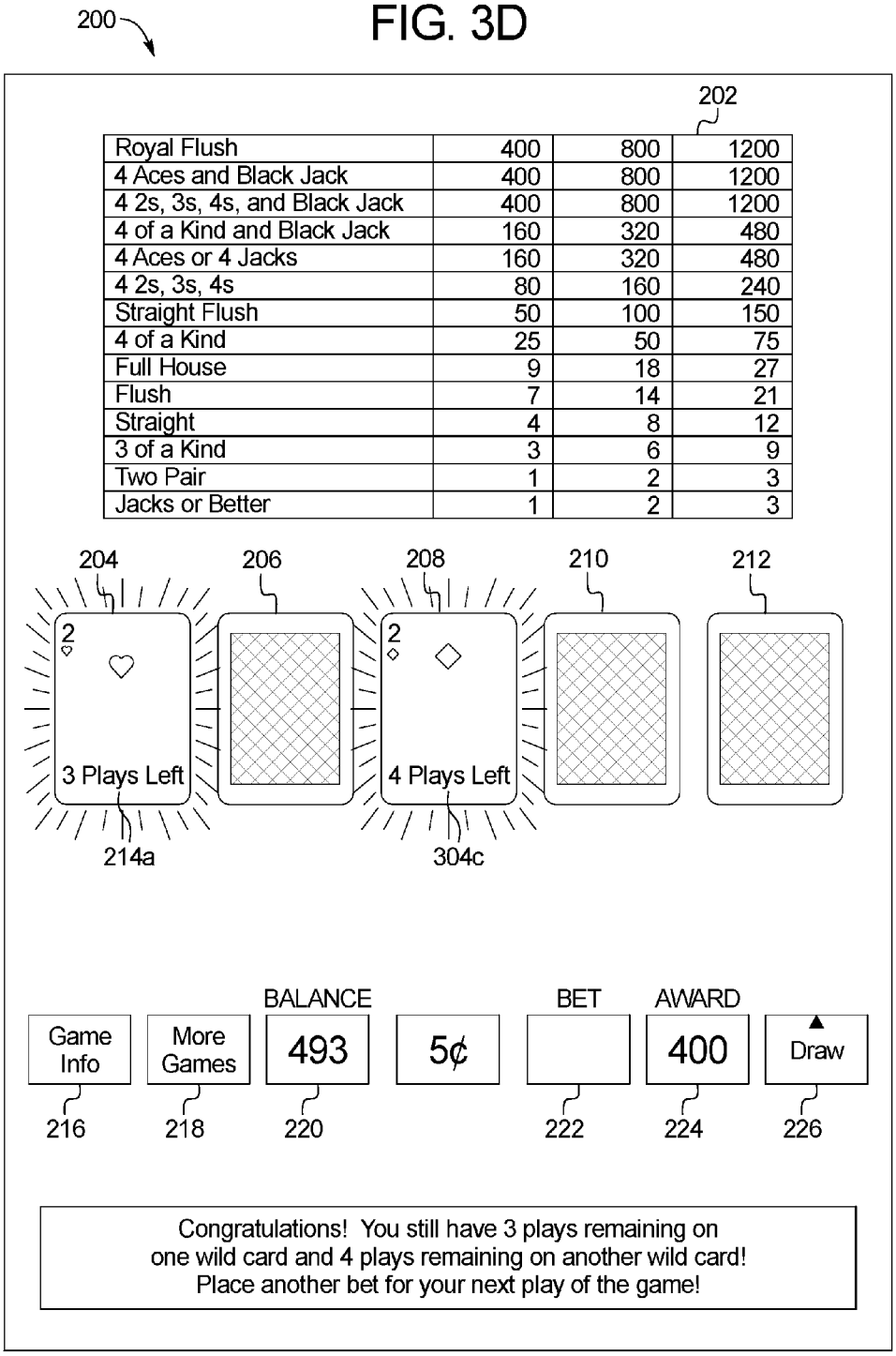

In this embodiment, the minimum decay value is one. Turning now to FIG. 3D, since the final hand includes two decay value cards, the 2♥ and the 2♦, the gaming system reduces the decay value of each decay value card. In this embodiment, the gaming system reduces the decay value of 2♥ from four to three plays of the card game, and the gaming system reduces the decay value of 2♦ from five to four pays of the card game. Since the decay value of both decay value cards is greater than the minimum decay value of one, the gaming system holds both decay value cards for a subsequent play of the card game as indicated by positions 204 and 208.

In this embodiment, the player will have at least two decay value cards that function as wild cards for at least the next three plays of the card game and the player will have at least one decay value card that functions as a wild card in the fourth play of the card game. Thus, the payer will start at least the next three pays of the card game with a guaranteed winning card combination and a guaranteed award based on the paytable 202. In addition to the decay value cards that the player currently has, the gaming system provides the player the opportunity to receive additional decay value cards with different decay values in each subsequent play of the game. Thus, the player may have more than two decay value cards at the same time in certain plays of the game, or the player may receive additional decay value cards in a play of the game after the decay value of the player's current decay value cards runs out. This is very exciting for the player and will keep the player engaged.

It should be appreciated, that in the above described example embodiment, the gaming system does not display the designated decay value cards within the first virtual deck of cards prior to displaying the initial hand of cards. Thus, the player does not know that the gaming system designated the 2♥, 2♣, 2♦, 2♠ within the virtual deck of cards as decay value cards until the player received the cards during the deal or draw phase of the card game. In an alternative embodiment, prior to each deal, the gaming system displays the decay value cards prior to the play of the card game. In an example of such an embodiment, prior to displaying any cards for the initial hand of the play of the card game, the gaming system displays one or more of the designated decay value cards so the player knows which cards and how many cards are decay value cards. Similarly, in the example embodiment described above, the gaming system did not display the decay value of each decay value card. Thus, the player did not know the decay value of any decay value cards until the gaming system displayed the decay value card and the respective decay value during the play of the card game. In an alternative embodiment, the gaming system displays one or more of the decay value cards within the first set of cards and the decay value of each card. In another variation of this alternative embodiment, the gaming system only displays the decay value cards without the decay values.

It should also be appreciated from the example embodiment above that the gaming system selects from a different virtual deck of cards for each play of the card game. Where one or more of the decay value cards are carried over from the previous play of the game. More specifically, as illustrated in the example embodiment above, for the first play of the card game the gaming system uses a first virtual deck of 52 cards. For the second play of the card game, in the example embodiment above, the gaming system completes the initial hand of cards for the play of the card game by randomly selecting from a second new virtual deck of cards as that from the first play of the card game. Since, in that example embodiment, the 2♥ was a decay value card held from a previous play of the card game, the gaming system randomly selected cards from a virtual deck not including the 2♥. In an alternative embodiment, as described in further detail below, a separate different deck of cards is used for each subsequent play of the card game.

In various embodiments, it should be appreciated that if one or more decay value cards are carried over from a previous play of the game, the wager for each subsequent play of the card game within a gaming session may not exceed the wager for the first play of the card game within a gaming session. That is, if for the first play of the game, the player places a wager of five credits, and the gaming system holds a decay value card from the first play of the game for the second play of the game, the player may not raise the wager to ten credits for the second play of the game.

Designating the Decay Value Cards

In various alternative embodiments, the present disclosure contemplates that the gaming system designates the decay value cards in a plurality of different ways. In the example embodiment described above, the gaming system designated four decay value cards. In an alternative embodiment, the gaming system designates less than four decay value cards. In various alternative embodiments, the quantity of decay value cards changes for each play of a card game or for a plurality of plays of a card game. In various embodiments the number of decay value cards for a play of a game within a gaming session is predetermined. In various alternative embodiments, the number of decay value cards for each play of a game within a gaming session is randomly determined.

In the example embodiment described above, the gaming system designated the same set of four decay value cards for a plurality of plays of the card game within a gaming session. In certain alternative embodiments, gaming system designates the same set of decay value cards for a predefined number of plays of the card game. In an example of one such embodiment, the gaming system designates the four Two's to be decay value cards for the first five plays of the card game. In this example embodiment, the gaming system designates a new set of decay value cards at the start of the sixth play of the card game within the gaming session. In other alternative embodiments, the gaming system designates the same set of decay value cards for a random number of plays of the card game within the gaming session. In an alternative embodiment, the gaming system designates one or more decay value cards for each play of the card game such that the decay value cards may be the same or different for multiple plays of the card game. In an example of such an embodiment, the decay value card for a first play of the card game may be the four Two's within a deck of cards and for the second play of the card game the decay value cards may be the four Kings within a deck of cards.

In the example embodiments described above, each hand may hold up to five decay value cards. In various alternative embodiments, the gaming system includes a different maximum number of decay value cards. It should be appreciated that the gaming system may deal additional decay value cards within the play of the card game and during each play of a card game within a gaming session.

In various embodiments, the gaming system predetermines which cards to designate as decay value cards. In other alternative embodiments, the gaming system randomly determines which cards to designate as decay value cards. More specifically, in various embodiments, each card within a deck of cards has the possibility to act as a decay value card. Additionally, any combination of cards within a deck of cards has the possibility to act as a decay value card. In the example embodiment described above, the four Two's within a single deck of cards were the decay value cards for each of a plurality of plays of the card game within that gaming session. In an alternative embodiment, for example, the designated decay value cards are all Kings, or all Fours or all hearts. In other alternative embodiments, the decay value cards are a combination of suits and numbers. For example, in one example embodiment, the decay value cards are all face cards that are hearts. In certain alternative embodiments, the decay value cards are unrelated. In one such example embodiment, the decay value cards are 10♣, 7♦, and 5♠.

Alternatives to Designating Decay Value Cards

In various alternative embodiments of the present disclosure, the gaming system does not designate decay value cards within the first set of cards prior to any cards being displayed. In one such example embodiment, the gaming system designates the decay value cards after the initial hand of cards are displayed. More specifically, in this example embodiment, the gaming system displays an initial hand of cards, then designates one of the displayed cards to be a decay value card and determines a decay value for that decay value card. In certain embodiments, the gaming system designates one or more decay value cards during the initial deal phase of the card game. In other alternative embodiments, the gaming system designates one or more decay value cards during the draw phase after the initial hand of cards are dealt. In another variation of this embodiment, the gaming system designates a decay value card during both the initial deal phase and the draw phase of the card game.

Evaluating Decay Value Cards

In various alternative embodiments of the present disclosure, each of the decay value cards provides the player an advantage. The decay value card has one or more functions. In the above described embodiment, the advantage is that each decay value card in the final hand functions as a wild card. In various alternative embodiments, each decay value card in the final hand is associated with a multiplier. In other alternative embodiments, each decay value card includes one or more functions, such as the decay value cards both functions as a wild card and is associated with a multiplier.

In various embodiments where decay value cards function as wild cards, the present disclosure contemplates that the gaming system can evaluate any awards based on any winning card combinations including the decay value cards in a plurality of different ways. More specifically, in the example embodiment described above with reference to FIGS. 2A, 2B, 2C, 2D, 3A, 3B, 3C and 3D, the gaming system evaluates each final hand using the same paytable regardless of whether the final hand includes any decay value cards. In an alternative embodiment, the gaming system evaluates any final hand including a decay value card against a separate different decay value card paytable. In an example of such an embodiment, if the final hand of the play of the game includes a decay value card, the gaming system evaluates that hand against a separate paytable than if the final hand did not include a decay value card. In certain variations of this embodiment, the decay value card paytable has a different increased average expected payout than a non-decay value card paytable. In another variation of this embodiment, the decay value card paytable includes different winning card combinations than the non-decay value card paytable. In another variation of this embodiment, the gaming system uses a different paytable depending on how many decay value cards are present in each hand.

It should be appreciated that in the example embodiments described above with reference to FIGS. 2A, 2B, 2C, 2D, 3A, 3B, 3C and 3D, the decay value card remains in play until the decay value is less than the minimum decay value for the play of the card game. In this embodiment, after the decay value of the decay value card is less than the minimum decay value for the play of the card game, the decay value card is returned to the deck at its original rank and suit.

In various alternative embodiments of the present disclosure, the decay value card provides the advantage in the form of a multiplier. In various embodiments, where the decay value card functions as a multiplier, the decay value represents the number of cards games for which the decay value card will be employed. In certain alternative embodiments where the decay value card is associated with a multiplier, the decay value represents one or both of: (1) the multiplier value; and (2) the number of card games for which the decay value card will be employed.

In certain embodiments of the present disclosure, the decay value card is associated with a static multiplier and the decay value associated with each decay value card represents the number of plays of the card game that the static multiplier will be employed. More specifically, in one example embodiment, the gaming system designates the 2♥, to be a decay value card that functions as a 5× multiplier. The gaming system determines that the decay value for the 2♥ is five plays of the card game. Thus, in this embodiment, if the gaming system displays the 2♥, the 2♥ is employed for five plays of the card game and the gaming system applies the 5× multiplier to the award for the winning card combination for the five plays of the card game.

In an alternative embodiment, the decay value card is associated with a changing multiplier and the decay value represents the number of plays of the card game that the changing multiplier will be employed. More specifically, in certain variations of this embodiment, for each decay value card, the gaming system determines: (1) a decay value, and (2) an initial multiplier value. In an example of this embodiment, the gaming system designates the 2♥ to be a decay value card that is associated with a changing multiplier, and the gaming system determines that: (1) the decay value is five plays of the card game, and (2) the initial multiplier value is 5×. In this example embodiment, for each play of the card game, the gaming system applies the multiplier value that corresponds to the decay value of the decay value card. Additionally, the gaming system reduces the decay value by one at the end of each play of the card game. Thus, both the quantity of plays of the card game remaining and the value of the multiplier are reduced for each subsequent play of the card game. For the first play of the card game of this embodiment, the gaming system applies a 5× multiplier to any award associated with the final hand of cards in the first play of the card game. For the second play of the card game, the decay value is reduced to four plays of the card game. Thus, the decay value card will remain for four more plays of the card game and the gaming system will apply a 4× multiplier to any award associated with the final hand of cards.

In a variation of this embodiment, the decay value is different from the initial multiplier value. In one example of this embodiment, the decay value is three plays of the card game and the initial multiplier value is 5×. Thus the gaming system applies the 5× multiplier to the awards associated with the final hand for first play of the card game. In this example embodiment, the gaming system applies a 4× multiplier to the final hand of the second play of the card game.

It should be appreciated that in various embodiments where the decay value card is associated with a multiplier, the card itself is evaluated at its rank and suit. More specifically, in the example embodiments described above, to determine whether the final hand of cards includes any awards for any winning card combinations, the gaming system evaluates the 2♥ decay value card as 2♥ (not as a wild card) and then applies the 5× multiplier to any award for the winning card combination. In certain variations of this embodiment, the 2♥ decay value card remains in play for each play of the card game until the decay value of the decay value card is less than the minimum decay value of the play of the card game. In an alternative embodiment, the decay value card is both associated with a multiplier and functions as a wild card. Thus, in an example of this embodiment, the 2♥ functions as a wild card and is associated with a 5× multiplier for five plays of the card game.

In another variation of this embodiment, the multiplier is associated with the position of the decay value card and the card itself is returned to the virtual deck at the end of each play of a card game. In an example of this embodiment, the gaming system designates the 2♥ as a decay value card and determines that it has a decay value of 5× for a first play of a card game. In this example embodiment, the card itself is evaluated at its rank and suit, as 2♥ for the first play of the card game. At the end of the first play of the card game, the gaming system reduces the decay value to four plays of the card game and the corresponding multiplier value to 4× and returns the 2♥ to the virtual deck of cards. The position in which the 2♥ was displayed will be associated with a 4× multiplier for the next play of the card game. In this example embodiment, for the next play of the card game, the gaming system will display a new card in that position. Thus, for each play of the card game, the final hand includes a different card in the decay value card position, and the decay value card position is associated with a multiplier.

Where a final hand includes multiple decay value cards, the gaming system adds the multiplier values of each decay value card within the final hand. In an example of one such embodiment, for a final hand including a decay value card having a decay value of 3× and a second decay value card of 2×, the gaming system will apply a 5× multiplier (i.e., 2×+3×) for the award for that play of the card game.

In various alternative embodiments of the present disclosure, the decay value card is a spreading decay value card. In an example of such an embodiment, if the initial hand for a play of a card game includes a decay value card, the gaming system may select a new card during the draw phase which also becomes a decay value card. In one example of this embodiment, the gaming system determines a decay value for the decay value card and the original decay value card maintains the existing decay value. In an alternative embodiment, if an existing decay value card spreads to a decay value card, the decay value of the original decay value card is distributed between the two decay value cards. In an example of such an embodiment, if an initial hand includes a decay value card with a decay value of four and a new card is randomly selected, the gaming system may spread the decay value of the original card to the new card by reducing the decay value of the original card to three and providing a decay value of 1 to the decay value card.

Determining the Decay Value

The present disclosure contemplates that the gaming system can determine the minimum decay value in a plurality of different ways. The minimum decay value is the least possible decay value for each decay value card that the gaming system holds for a subsequent play of the card game. In the above described embodiments of FIGS. 2A, 2B, 2C, 2D, 3A, 3B, 3C, and 3D, the minimum decay value is a predetermined value of one In certain alternative embodiments, the minimum decay value is a different predetermined value such as three or four. In another alternative embodiment, the minimum decay value is randomly generated.

In various embodiments, the minimum decay value remains the same minimum decay value for a plurality of games within a gaming session. In various alternative embodiments, the minimum decay value is different for each play of the card game within the gaming session.

Additionally, the present disclosure contemplates that the gaming system can determine the decay value of each decay value card in a plurality of ways. In the example embodiment described above of FIGS. 2A, 2B, 2C, 2D, 3A, 3B, 3C, and 3D, the decay value for each decay value card is predetermined to be five plays of a card game, for each of a plurality of games within the gaming session. In another alternative embodiment, the gaming system randomly determines the decay value of all decay value cards for a plurality of games within a gaming session. In other alternative embodiments, the gaming system determines a different decay value for each decay value card. More specifically, using the example embodiment described above, instead of determining that the decay value of all of the decay value cards is five plays of the card game, in this alternative embodiment, the decay value for the 2♥ is five, the decay value for the 2♣ is 3, and the decay value for the 2♠ and is 2.

In another alternative embodiment of the present disclosure, the decay value for one or more decay value card changes for each play of the card game. More specifically, in the embodiment described above, the decay value for each decay value card remained five for each of a plurality of plays of a card game. In another variation of this embodiment the decay value of one or more decay value card changes for each play of the card game.

It should be appreciated that in the various example embodiments described above, after or at the end of the play of the card game, the gaming system reduces the decay value of each decay value card by one. In certain alternative embodiments, the gaming system reduces the decay value of each decay value card for every other play of the card game in which the decay value card is displayed. More specifically, the decay value of each decay value card displayed in the final hand of cards remains constant for two plays of the card game. In an alternative embodiment, the gaming system randomly determines when to reduce the decay value of the decay value cards.

In another alternative embodiment, the gaming system reduces the decay value of a decay value card under certain predefined conditions such as if the final hand includes a predefined designated card combination, More specifically, in one example embodiment, the gaming system reduces the decay value of each decay value card within a final hand of cards if the final hand of cards includes a winning card combination of "Jacks or Better." Similarly, in an alternative embodiment, the gaming system does not reduce the decay value of any decay value cards if the final hand includes a designated card combination.

In various alternative embodiments of the present disclosure, the gaming system reduces the decay value of certain of the decay value cards in the final hand. For example, in one embodiment, the gaming system only reduces the decay value of each even numbered decay value cards. In another embodiment, the gaming system reduces the decay value of any decay value card that is a specific suit such as a heart. In another embodiment, the gaming system randomly determines which decay value cards to reduce the decay value of in each play of the card game.

In various alternative embodiments of the present disclosure, the gaming system alters the amount by which it reduces the decay value of each decay value card. For example, in one example embodiment, the gaming system reduces the decay value of the decay value cards by more than one. In another embodiment, the gaming system randomly determines how much to reduce the decay value by at the end of each play of the card game. It should be appreciated that in various alternative embodiments, the gaming system employs a combination of the above described variations. For example, in one embodiment, for each decay value card that is a heart, the gaming system reduces the decay value by two, for each decay value card that is a spade, the gaming system only reduces the decay value by one at every other play of the card game.

In the example embodiments described above, the decay value is associated with each decay value card. In the example embodiment above, the player knows how many more card games each decay value card will remain. In certain alternative embodiments, the decay value of each decay value card is not displayed to the player. In an example of one such embodiment, the gaming system displays a decay value card and continues to hold the decay value card for a subsequent play of the card game until there is no remaining decay value. In this example embodiment, the player does not know what the decay value is or when there will be no decay value remaining.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
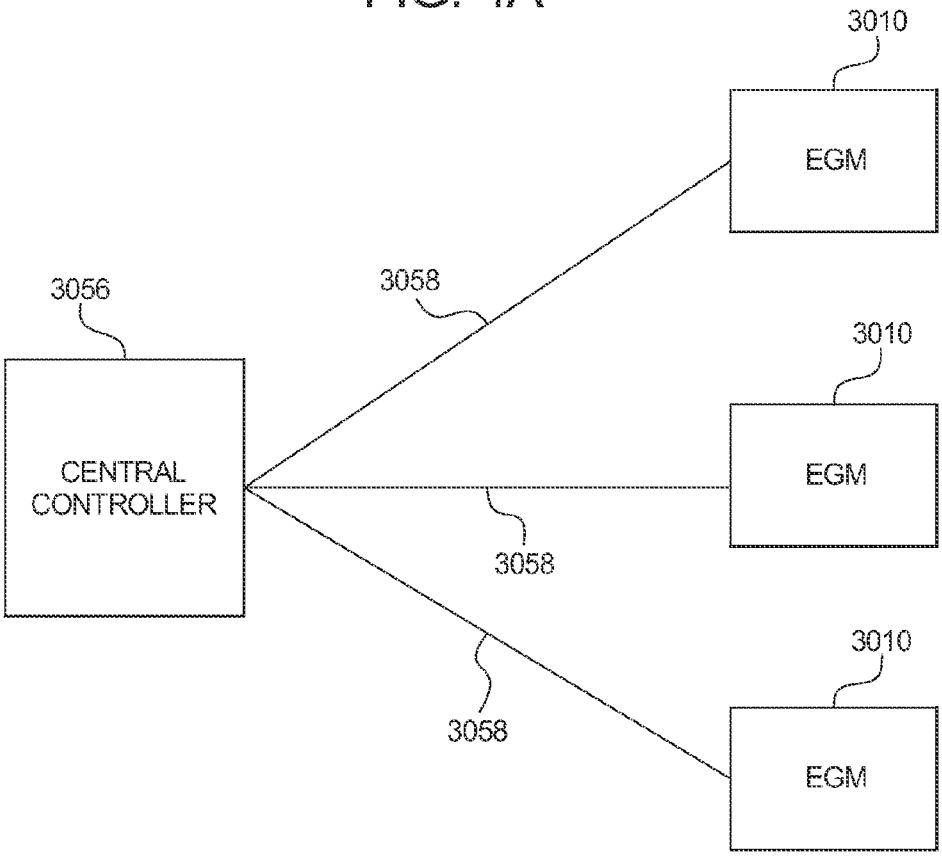
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 3010 that are each configured to communicate with a central server, central controller, or remote host 3056 through a data network 3058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an Internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
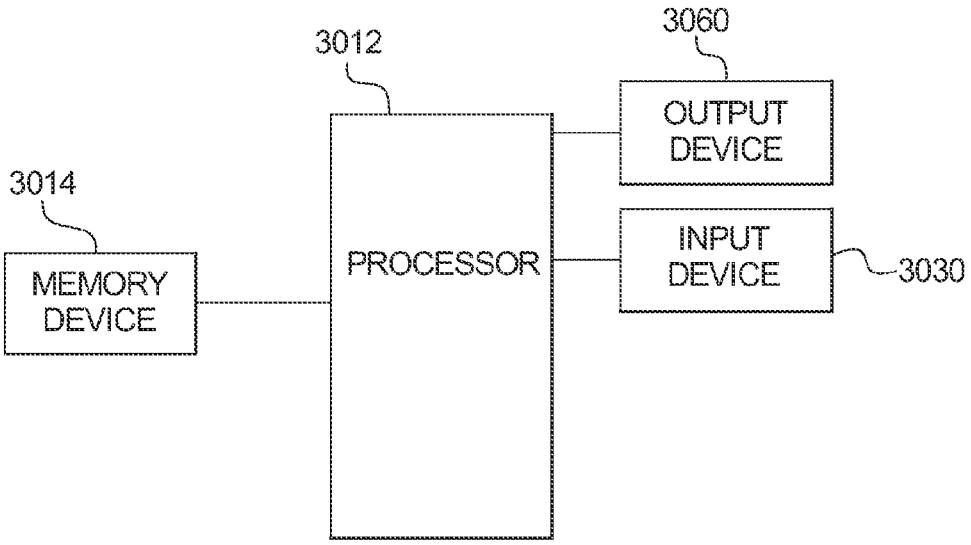
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs), FIG. 4B illustrates an example EGM including a processor 3012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 3014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
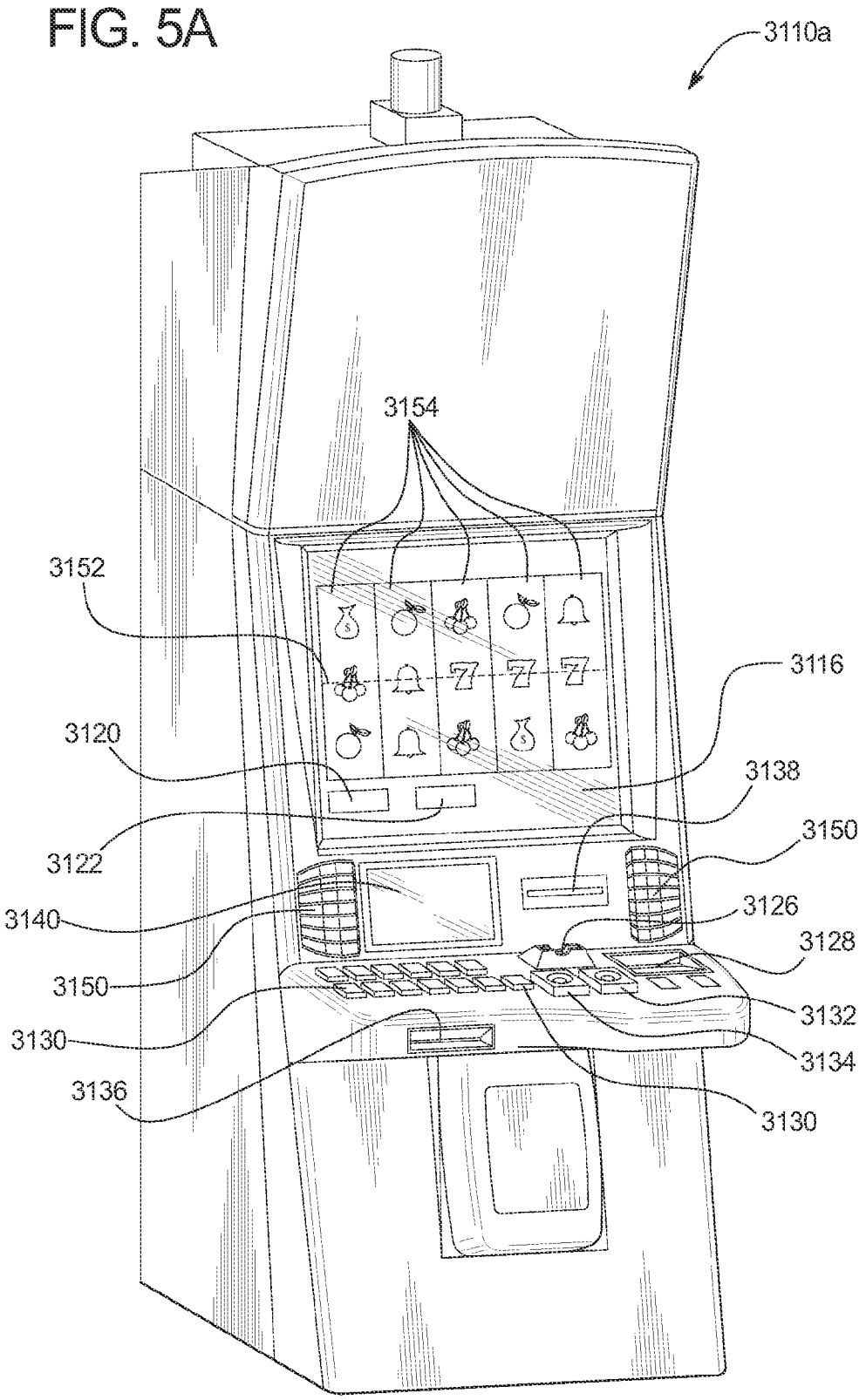
FIGS. 5A and 5B are perspective views of example alternative embodiments of the gaming system of the present disclosure.
Figure 5B:
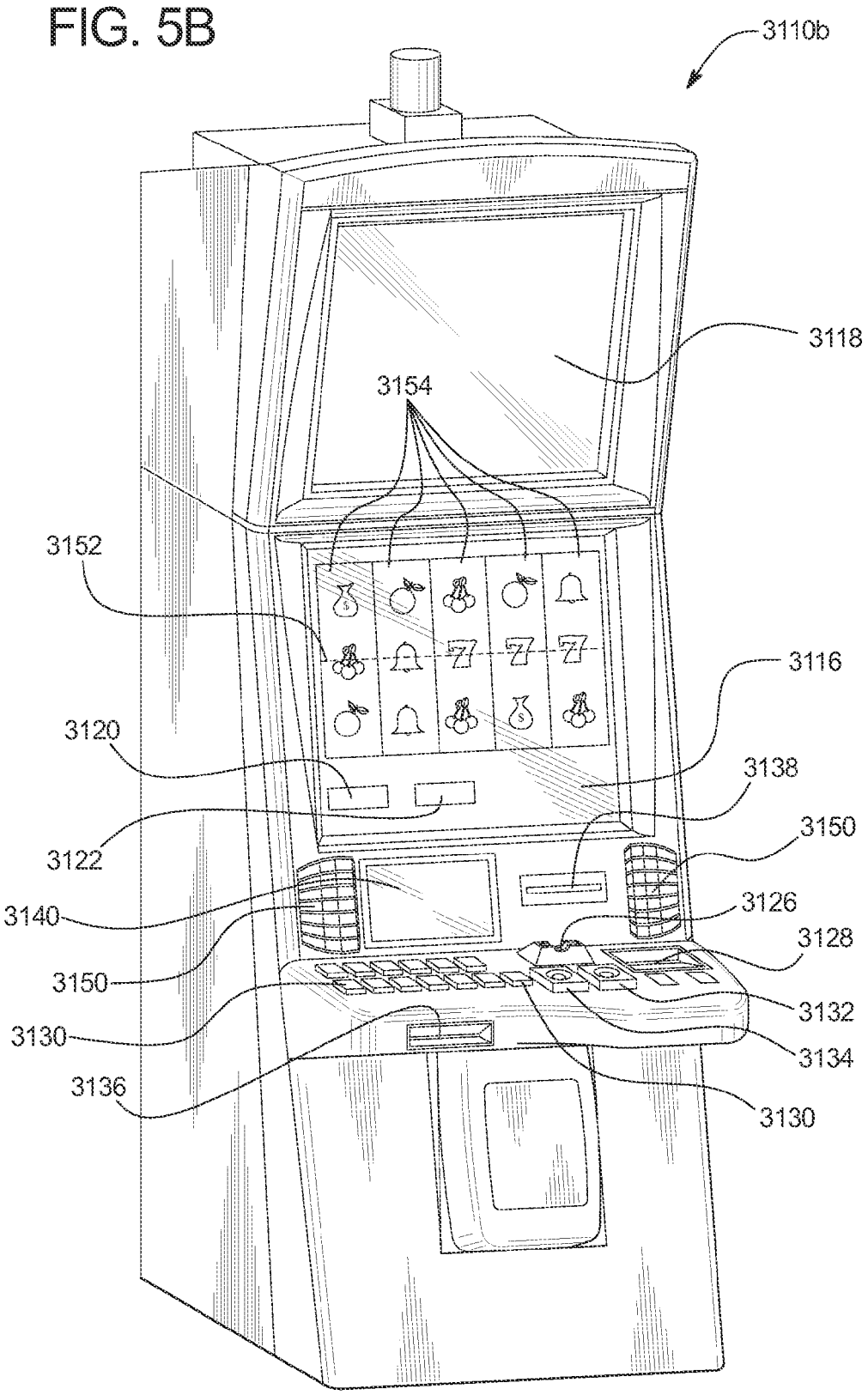

In various embodiments, the EGM includes one or more input devices. The input devices may include any suitable device that enables an input signal to be produced and received by the at least one processor of the EGM. The example EGM illustrated in FIG. 4B includes at least one input device 3030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 3128, and (b) a coin slot 3126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a card game on the EGM or a sequence of events associated with the EGM following appropriate funding of the EGM. The example EGMs illustrated in FIGS. 5A and 5B each include a game play activation device in the form of a game play initiation button 3132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 3134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 3138. The card reader is configured to read a player identification card inserted into the card reader.

In various embodiments, the EGM includes one or more output devices. The example EGM illustrated in FIG. 4B includes at least one output device 3060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 3116, a player tracking display 3140, a credit display 3120, and a bet display 3122. The example EGM illustrated in FIG. 5B includes a central display device 3116, an upper display device 3118, a player tracking display 3140, a player tracking display 3140, a credit display 3120, and a bet display 3122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 3136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 3150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. patent application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be Implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaining system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. patent application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. patent application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. patent application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B include a payline 3152 and a plurality of reels 3154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. patent application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. patent application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game (s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. patent application Publication Nos. 2007/0123341, 200810070680, 2008/0176650, and 200910124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions, which when executed by the at least one processor, cause the at least one processor to operate with the at least one display device and the plurality of input devices to:

(a) establish a credit balance for a gaming session which includes one or more plays of a game, the established credit balance based at least in part on a monetary value associated with a physical item following receipt of the physical item by the acceptor;

(b) for at least one play of the game:

(i) place a wager responsive to receipt of an actuation of a wager button, the credit balance decreasable by the wager;

(ii) prior to displaying an initial hand of cards for the play of the game, designate one or more cards from a first set of cards to be decay value cards, wherein each decay value card is designated without regard to any prior winning card combination, and said decay value card includes a decay value, which represents a quantity of subsequent plays of the game that said decay value card will be provided to a player;

(iii) for an initial hand of cards:

(A) display any cards from a previous play of the game which are decay value cards with at least a minimum decay value;

(B) complete the initial hand of cards by randomly selecting cards from the first set of cards for a final hand of cards; and (C) display the complete final hand of cards; and (iv) determine any awards associated with the final hand of cards;

(v) display any awards associated with the final hand of cards; and (vi) if the final hand of cards includes a decay value card having at least the minimum decay value, hold the decay value card for a subsequent play of the game; and (c) initiate a payout associated with the credit balance responsive to receipt of an actuation of the cashout button.

2. The gaming system of claim 1, wherein the at least one memory device which stores a plurality of instructions, which when executed by the at least one processor, cause the at least one processor to operate with the at least one display device and the plurality of input devices to:

for the initial hand of cards (i) display any cards from the previous play of the game which are decay value cards with at least the minimum decay value;

(ii) complete the initial hand of cards by randomly selecting cards from the first set of cards;

(iii) display the complete initial hand of cards;

(iv) receive a selection of zero, one, or a plurality of the cards in the initial hand to discard and discard any selected cards; and (v) for each discarded card, replace said discarded card with a replacement card from the first set of cards for the final hand of cards and display the final hand of cards.

3. The gaming system of claim 1 wherein if the final hand of cards includes any decay value cards, for each decay value card:

(i) reduce the decay value of said decay value card; and (ii) if the decay value of said decay value card is at least the minimum decay value, hold said decay value card for the subsequent play of the game.

4. The gaming system of claim 1, wherein the decay value card functions as a wild card.

5. The gaming system of claim 1, wherein if the decay value card is associated with a multiplier, the at least one processor operates to determine the decay value and the initial multiplier value associated with the decay value card.

6. The gaming system of claim 1, wherein if the displayed cards of the final hand include any decay value cards associated with a multiplier, for each decay value card:

(i) reduce the decay value of the decay value card;

(ii) reduce the multiplier value associated with the decay value card; and (iii) hold the decay value card having at least the minimum decay value for the subsequent play of the game.

7. The gaming system of claim 1, wherein for the subsequent play of the game including an initial hand of cards with one or more decay value cards from the previous play of the game, the first set of cards is a different virtual deck of cards from the first set of cards of the previous play of the game.

8. The gaming system of claim 7, wherein for the subsequent play of the game including the initial hand of cards with one or more decay value cards from the previous play of the game, the first set of cards is the virtual deck of cards excluding the decay value cards held from the previous play of the game.

9. The gaming system of claim 1, wherein more than one decay value cards are displayed for at least one play of the game.

10. The gaming system of claim 1, wherein at least one play of the game includes a predetermined maximum quantity of decay value cards for the final hand of cards.

11. The gaming system of claim 1, wherein at least two decay value cards in at least one play of the game have different decay values.

12. A method of operating a gaming system, said method comprising:

causing at least one processor to execute a plurality of instructions stored in at least one memory device to operate with at least one display device and a plurality of input devices to:

(a) receive, by an acceptor, a physical item associated with a monetary value;

(b) establish a credit balance for a gaming session which includes one or more plays of a game, the established credit balance based at least in part on the monetary value associated with the received physical item;

(c) for at least one play of the game:

(i) receive an actuation of a wager button;

(ii) place, by the at least one processor, a wager responsive to receipt of the actuation of the wager button, the credit balance decreasable by the wager;

(iii) prior to displaying an initial hand of cards for the play of the game, designate one or more cards from a first set of cards to be decay value cards, wherein each decay value card is designated without regard to any prior winning card combination, and said decay value card includes a decay value, which represents a quantity of subsequent plays of the game that said decay value card will be provided to a player;

(iv) for an initial hand of cards:

(A) display any cards from a previous play of the game which are decay value cards with at least a minimum decay value;

(B) complete the initial hand of cards by randomly selecting cards from the first set of cards for a final hand of cards; and (C) display the complete final hand of cards; and (v) determine any awards associated with the final hand of cards;

(vi) display any awards associated with the final hand of cards; and (vii) if the final hand of cards includes a decay value card having at least the minimum decay value, hold the decay value card for a subsequent play of the game;

(d) receive an actuation of a cashout button; and (e) initiate, by the at least one processor, a payout responsive to receipt of the actuation of the cashout button.

13. The method of claim 12, which includes causing the processor to execute a plurality of instructions stored in the at least one memory device to operate with the at least one display device and the plurality of input devices to:

for the initial hand of cards:

(i) display any cards from the previous play of the game which are decay value cards with at least the minimum decay value;

(ii) complete the initial hand of cards by randomly selecting cards from the first set of cards;

(iii) display the complete initial hand of cards;

(iv) receive a selection of zero, one, or a plurality of the cards in the initial hand to discard and discard any selected cards; and (v) for each discarded card, replace said discarded card with a replacement card from the first set of cards for a final hand of cards and display the final hand of cards.

14. The method of claim 12, which includes causing the processor to, if the final hand of cards includes any decay value cards, for each decay value card:

(i) reduce the decay value of said decay value card; and (ii) if the decay value of said decay value card is at least the minimum decay value, hold said decay value card for the subsequent play of the game.

15. The method of claim 12, wherein the decay value card functions as a wild card.

16. The method of claim 12, wherein if the decay value card is associated with a multiplier, causing the processor to determine the decay value and the initial multiplier value associated with the decay value card.

17. The method of claim 12, which includes if the displayed cards of the final hand include any decay value cards associated with a multiplier, for each decay value card causing the processor to:

(i) reduce the decay value of the decay value card;

(ii) reduce the multiplier value associated with the decay value card; and (iii) hold the decay value card having at least the minimum decay value for the subsequent play of the game.

18. The method of claim 12, wherein for the subsequent play of the game including an initial hand of cards with one or more decay value cards from the previous play of the game, the first set of cards is a different virtual deck of cards from the first set of cards of the previous play of the game.

19. The method of claim 18, wherein for the subsequent play of the game including the initial hand of cards with one or more decay value cards from the previous play of the game, the first set of cards is the virtual deck of cards excluding the decay value cards held from the previous play of the game.

20. The method of claim 12, wherein more than one decay value cards are displayed for at least one play of the game.

21. The method of claim 12, wherein at least one play of the game includes a predetermined maximum quantity of decay value cards for the final hand of cards.

22. The method of claim 12, wherein at least two decay value cards in at least one play of the game have different decay values.

23. The method of claim 12, which is provided through a data network.

24. The method of claim 23, wherein the data network is an internet.

25. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions, which when executed by the at least one processor, cause the at least one processor to operate with the at least one display device and the plurality of input devices to:

(a) establish a credit balance for a gaming session which includes one or more plays of a game, the established credit balance based at least in part on a monetary value associated with a physical item following receipt of the physical item by the acceptor;

(b) for at least one play of the game:

(i) place a wager responsive to receipt of an actuation of a wager button, the credit balance decreasable by the wager;

(ii) designate one or more cards from a first set of cards to be decay value cards, each decay value card having a decay value;

(iii) for an initial hand of cards:

(A) display any cards from a previous play of the game which are decay value cards with at least a minimum decay value;

(B) complete the initial hand of cards by randomly selecting cards from the first set of cards for a final hand of cards; and (C) display the complete final hand of cards;

(iv) determine any awards associated with the final hand of cards;

(v) display any awards associated with the final hand of cards;

(vi) if the displayed cards of the final hand include any decay value cards associated with a multiplier, for each decay value card associated with the multiplier:

(A) reduce the decay value of the decay value card;

(B) reduce the multiplier value associated with the decay value card; and (C) hold the decay value card having at least the minimum decay value for the subsequent play of the game; and (vii) if the final hand of cards includes a decay value card having at least the minimum decay value, hold the decay value card for a subsequent play of the game; and (c) initiate a payout associated with the credit balance responsive to receipt of an actuation of the cashout button.

26. The gaming system of claim 25, wherein the decay value card functions as a wild card.

27. The gaming system of claim 25, wherein more than one decay value cards are displayed for at least one play of the game.

28. A method of operating a gaming system, said method comprising:

causing at least one processor to execute a plurality of instructions stored in at least one memory device to operate with at least one display device and a plurality of input devices to:

(a) receive, by an acceptor, a physical item associated with a monetary value;

(b) establish a credit balance for a gaming session which includes one or more plays of a game, the established credit balance based at least in part on the monetary value associated with the received physical item (c) for at least one play of the game:

(i) receive an actuation of a wager button;

(ii) place, by the at least one processor, a wager responsive to receipt of the actuation of the wager button, the credit balance decreasable by the wager;

(iii) designate one or more cards from a first set of cards to be decay value cards, each decay value card having a decay value;

(iv) for an initial hand of cards:

(A) display any cards from a previous play of the game which are decay value cards with at least a minimum decay value;

(B) complete the initial hand of cards by randomly selecting cards from the first set of cards for a final hand of cards; and (C) display the complete final hand of cards;

(v) determine any awards associated with the final hand of cards;

(vi) display any awards associated with the final hand of cards;

(vii) if the displayed cards of the final hand include any decay value cards associated with a multiplier, for each decay value card associated with the multiplier:

(A) reduce the decay value of the decay value card;

(B) reduce the multiplier value associated with the decay value card; and (C) hold the decay value card having at least the minimum decay value for the subsequent play of the game; and (viii) if the final hand of cards includes a decay value card having at least the minimum decay value, hold the decay value card for a subsequent play of the game;

(d) receive an actuation of a cashout button; and (e) initiate, by the at least one processor, a payout responsive to receipt of the actuation of the cashout button.

29. The method of claim 28, wherein the decay value card functions as a wild card.

30. The method of claim 28, wherein more than one decay value cards are displayed for at least one play of the game.

* * * * *